US009170508B2

(12) United States Patent
Katoh et al.

(10) Patent No.: US 9,170,508 B2
(45) **Date of Patent: *Oct. 27, 2015**

(54) PARTICULATE MATERIAL PRODUCTION METHOD AND APPARATUS, TONER PRODUCTION METHOD AND APPARATUS, AND TONER

(71) Applicant: Ricoh Company, Ltd., Tokyo (JP)

(72) Inventors: Kiyotada Katoh, Shizuoka (JP); Yasutada Shitara, Shizuoka (JP); Minoru Masuda, Shizuoka (JP); Yoshihiro Norikane, Kanagawa (JP); Kenta Kenjoh, Shizuoka (JP); Satoshi Takahashi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/166,253

(22) Filed: Jan. 28, 2014

(65) Prior Publication Data

US 2014/0141110 A1 May 22, 2014

Related U.S. Application Data

(62) Division of application No. 13/438,375, filed on Apr. 3, 2012, now Pat. No. 8,673,534.

(30) Foreign Application Priority Data

Apr. 19, 2011 (JP) ..... 2011/092876

(51) Int. Cl.
*G03G 9/00* (2006.01)
*G03G 9/08* (2006.01)

(52) U.S. Cl.
CPC ..... *G03G 9/0802* (2013.01); *G03G 9/0819* (2013.01)

(58) Field of Classification Search
CPC G03G 9/0825; G03G 9/0819; G03G 9/08797
USPC ..... 430/110.1; 425/6
See application file for complete search history.

(56) References Cited

U.S. PATENT DOCUMENTS 5,721,083 A 2/1998 Masuda et al.
6,406,826 B1 6/2002 Suzuki et al.

(Continued)

FOREIGN PATENT DOCUMENTS

JP 61-18844 U 2/1986
JP 5-212263 A 8/1993

(Continued)

OTHER PUBLICATIONS

U.S. Appl. No. 14/143,601, filed Dec. 30, 2013, Inventor: Inoue, et al.

(Continued)

*Primary Examiner* — Hoa V Le
(74) *Attorney, Agent, or Firm* — Oblon, McClelland, Maier & Neustadt, L.L.P.

(57) ABSTRACT

The particulate material production method includes vibrating a particulate material composition liquid in a liquid column resonance chamber having at least one nozzle to form a standing wave in the particulate material composition liquid caused by liquid column resonance, so that droplets of the particulate material composition liquid are ejected in a droplet ejection direction from the nozzle so as to fly in a space in a flight direction; feeding a gas in a direction substantially perpendicular to the droplet ejection direction to change the flight direction of the ejected droplets; and solidifying the droplets in the space to produce a particulate material. The particulate material composition liquid includes at least a solvent and a component of the particulate material dissolved or dispersed in the solvent, and the nozzle is located at a location corresponding to an anitnode of the standing wave.

6 Claims, 11 Drawing Sheets

(56) References Cited

U.S. PATENT DOCUMENTS

| | | | | |
|---|---|---|---|---|
| 6,818,369 | B2 | 11/2004 | Sugiura et al. | |
| 6,828,075 | B2 | 12/2004 | Suzuki et al. | |
| 6,861,191 | B2 | 3/2005 | Mochizuki et al. | |
| 7,169,522 | B2 | 1/2007 | Sugiura et al. | |
| 7,183,029 | B2 | 2/2007 | Masuda et al. | |
| 7,522,857 | B2 | 4/2009 | Hasegawa et al. | |
| 7,713,672 | B2 | 5/2010 | Watanabe et al. | |
| 7,718,340 | B2 | 5/2010 | Iwamoto et al. | |
| 7,759,036 | B2 | 7/2010 | Utsumi et al. | |
| 7,862,973 | B2 | 1/2011 | Nakayama et al. | |
| 7,985,518 | B2 | 7/2011 | Shu et al. | |
| 8,007,974 | B2 | 8/2011 | Nakayama et al. | |
| 8,029,961 | B2 | 10/2011 | Kuramoto et al. | |
| 8,034,523 | B2 | 10/2011 | Hasegawa et al. | |
| 8,034,526 | B2 | 10/2011 | Watanabe et al. | |
| 8,084,176 | B2 | 12/2011 | Iwamoto et al. | |
| 8,105,742 | B2 | 1/2012 | Norikane et al. | |
| 8,758,973 | B2 * | 6/2014 | Makabe et al. | 430/137.1 |
| 8,765,349 | B2 * | 7/2014 | Norikane et al. | 430/137.1 |
| 2006/0068306 | A1 | 3/2006 | Shu et al. | |
| 2006/0093943 | A1 | 5/2006 | Shu et al. | |
| 2007/0275315 | A1 | 11/2007 | Nagatomo et al. | |
| 2009/0117486 | A1 | 5/2009 | Watanabe et al. | |
| 2009/0239170 | A1 | 9/2009 | Honda et al. | |
| 2009/0325100 | A1 | 12/2009 | Watanabe et al. | |
| 2010/0003613 | A1 | 1/2010 | Honda et al. | |
| 2010/0021209 | A1 | 1/2010 | Watanabe et al. | |
| 2010/0227267 | A1 | 9/2010 | Shitara et al. | |
| 2010/0297548 | A1 | 11/2010 | Honda et al. | |
| 2011/0014565 | A1 | 1/2011 | Norikane et al. | |
| 2011/0305987 | A1 | 12/2011 | Yohichiroh et al. | |
| 2012/0070777 | A1 | 3/2012 | Makabe et al. | |
| 2012/0094231 | A1 | 4/2012 | Norikane et al. | |
| 2013/0069263 | A1 | 3/2013 | Katoh et al. | |
| 2013/0273188 | A1 | 10/2013 | Takahashi et al. | |
| 2014/0038100 | A1 | 2/2014 | Katoh et al. | |

FOREIGN PATENT DOCUMENTS

| | | |
|---|---|---|
| JP | 2007-199463 | 8/2007 |
| JP | 2008-286947 | 11/2008 |
| JP | 2011-8229 | 1/2011 |
| JP | 2012-198494 A | 10/2012 |

OTHER PUBLICATIONS

Office Action issued on Mar. 6, 2015 in Japanese Patent Application No. 2011-092876.

* cited by examiner

BASIC PARTICLE (4.2 [μm])

UNITED TWO PARTICLES (5.3 [μm])

UNITED THREE PARTICLES (6.1 [μm])

UNITED FOUR PARTICLES (6.7 [μm])

BASIC PARTICLE

AGGREGATED TWO PARTICLES

AGGREGATED THREE PARTICLES

PARTICULATE MATERIAL PRODUCTION METHOD AND APPARATUS, TONER PRODUCTION METHOD AND APPARATUS, AND TONER

CROSS-REFERENCE TO RELATED APPLICATIONS

The present application is a Divisional of U.S. application Ser. No. 13/438,375, filed Apr. 3, 2012, now allowed, the entire contents of which are hereby incorporated by reference. This patent application is based on and claims priority pursuant to 35 U.S.C. §119 to Japanese Patent Application No. 2011-092876 filed on Apr. 19, 2011 in the Japan Patent Office, the entire disclosure of which is hereby incorporated herein by reference.

FIELD OF THE INVENTION

The present invention relates to a particulate material production method and a particulate material production apparatus. In addition, the present invention also relates to a toner production method and a toner production apparatus. Further, the present invention relates to a toner.

BACKGROUND OF THE INVENTION

Uniformly-shaped particulate resins can be used for various purposes such as electrophotographic toners, spacers for use in liquid crystal panels, colored particles for use in electronic papers, and carriers for medicines. Specific examples of the method for producing such uniformly-shaped particulate resins include methods in which a uniformly-shaped particulate resin is produced by making a reaction in a liquid, such as soap-free polymerization methods. Soap-free polymerization methods have advantages such that a particulate resin having a relatively small particle diameter and a sharp particle diameter distribution can be produced; and the particle form is nearly spherical, but have drawbacks such that a long time, and large amounts of water and energy are necessary for producing a particulate material because it takes time to perform such a polymerization reaction, it takes time to remove a solvent (typically water) from the liquid in which the reaction is performed, resulting in deterioration of production efficiency, and it is necessary to perform various processes such as a process for separating the resultant particulate material, and processes for washing and drying the particulate material after producing the particulate material in the liquid.

In attempting to solve the problems mentioned above, one of the present inventors and another inventor propose a toner production method using an ejection granulation method. Specifically, the toner production method uses a droplet ejection unit for ejecting droplets of a toner composition liquid including a solvent and toner components such as a binder resin and a colorant. The droplet ejection unit has a thin film, which has multiple nozzles and which is periodically vibrated up and down by an electromechanical converter serving as a vibrator to periodically change the pressure in a chamber, which contains the toner composition liquid and which includes the thin film having the multiple nozzles as a constitutional member, thereby ejecting droplets of the toner composition liquid from the nozzles to a space present below the nozzles. The thus ejected droplets of the toner composition liquid naturally fall through the space and proceed in the same direction, thereby forming lines of droplets of the toner composition liquid. In this regard, the ejected droplets are reshaped so as to be spherical due to the difference in surface tension between the toner component liquid and air in the space. The reshaped droplets are then dried, resulting in formation of a particulate toner.

In the toner production method, the falling speed of the ejected droplets decreases due to friction of air, and thereby the distance between a first droplet and a second droplet ejected after the first droplet gradually decreases, resulting in uniting of the droplets. Since the thus united droplets increase the volume thereof, the falling speed of the united droplets decreases due to friction of air, and therefore the united droplets tend to be further united with following droplets. Thus, there is a mixture of single droplets and united droplets in the space. When the mixture is dried, toner particles having different particle diameters are formed. Therefore, it is hard to form a uniformly-shaped particulate toner.

In attempting to solve the droplet uniting problem, one of the present inventors and other inventors propose a toner production method. In the toner production method, line of droplets of a toner composition liquid sequentially ejected from multiple nozzles are fed through a passage to a drying region, which is present on a downstream side of the space and in which the droplets are dried, and airflow is formed in the passage toward the drying region so that the droplets are fed by the airflow, to prevent uniting of the droplets.

In this toner production method, a large amount of air is supplied vertically from an entrance, which is located in the vicinity of droplet ejection nozzles, to the space by applying a pressure thereto using a pump or the like. In this regard, the pressure at the entrance is higher than that in peripheral areas in the space because the pressure of supplied air is added to the pressure of air used for ejecting droplets, and therefore the pressure in the peripheral areas decreases as the areas are apart in the lateral direction from the lines of droplets, resulting formation of pressure difference in the lateral direction in the space. Therefore, air supplied from the entrance is attracted by the peripheral areas, which have a low pressure, and then gradually spreads in the space. Accordingly, the lines of droplets are also spread by the airflow in the lateral direction, and a droplet in a line of droplets tends to be united with another droplet in the adjacent line of droplets before reaching the drying region.

In attempting to solve the droplet uniting problem, some of the present inventors and other inventors propose another toner production method. In the toner production method, air is supplied in the same direction as the droplet ejection direction to form a first airflow in the space, while air is supplied in a direction at an angle of less than 120° relative to the direction of the first airflow to form a second airflow in the space. In this case, the velocity of the droplets of the toner composition liquid is increased in the droplet ejection direction, but the velocity is gradually decreased. Therefore, the above-mentioned droplet spreading phenomenon is caused. In attempting to prevent occurrence of the droplet spreading phenomenon, the second airflow is supplied to each droplet at an angle of less than 120°. By supplying the second airflow, the feeding direction of the droplet is forcibly changed, and the distance between two adjacent droplets in the droplet feeding direction is increased, thereby preventing occurrence of the droplet uniting problem.

Since this toner production method uses two airflow generating devices, the costs of the toner production apparatus increase.

For these reasons, the inventors recognized that there is a need for a particulate material production method which can produce a uniformly-shaped particulate material at low costs without causing the droplet uniting problem.

BRIEF SUMMARY OF THE INVENTION

As an aspect of the present invention, a particulate material production method is provided which includes vibrating a particulate material composition liquid in a liquid column resonance chamber having at least one nozzle to form a standing wave in the particulate material composition liquid caused by liquid column resonance, so that droplets of the particulate material composition liquid are ejected in a droplet ejection direction from the at least one nozzle so as to fly in a space in a flight direction, wherein the particulate material composition liquid includes at least a solvent and a component of a particulate material dissolved or dispersed in the solvent, and the at least one nozzle is located at a location corresponding to an anitnode of the standing wave; feeding a gas in a direction substantially perpendicular to the droplet ejection direction to change the flight direction of the ejected droplets; and solidifying the droplets in the space to produce the particulate material.

As another aspect of the present invention, a particulate material production apparatus is provided which includes a droplet ejector to eject droplets, a gas feeder, and a solidifying device to solidify the droplets. The droplet ejector includes a liquid column resonance chamber which contains a particulate material composition liquid therein and which has at least one nozzle, wherein the particulate material composition liquid includes at least a solvent and a component of a particulate material dissolved or dispersed in the solvent; and a vibrator to vibrate the particulate material composition liquid in the liquid column resonance chamber to form a standing wave in the particulate material composition liquid, so that droplets of the particulate material composition liquid are ejected in a droplet ejection direction from the at least one nozzle so as to fly in a space in a flight direction, wherein the at least one nozzle is located at a location corresponding to an anitnode of the standing wave. The gas feeder feeds a gas in a direction substantially perpendicular to the droplet ejection direction to change the flight direction of the ejected droplets. The solidifying device solidifies the ejected droplets in the space to form a particulate material.

When a toner composition liquid including at least a binder resin, a colorant, and a solvent in which the binder resin and the colorant are dissolved or dispersed is used as the particulate material composition liquid, a uniformly-shaped toner can be produced by the particulate material method and apparatus.

As yet another aspect of the present invention, a toner is provided which includes at least a binder resin and a colorant and which is prepared by the particulate material production method mentioned above.

The aforementioned and other aspects, features and advantages will become apparent upon consideration of the following description of the preferred embodiments taken in conjunction with the accompanying drawings.

DETAILED DESCRIPTION OF THE INVENTION

Initially, a toner production apparatus, which is an example of the particulate material production apparatus of the present invention, will be described by reference to drawings.

Figure 1:
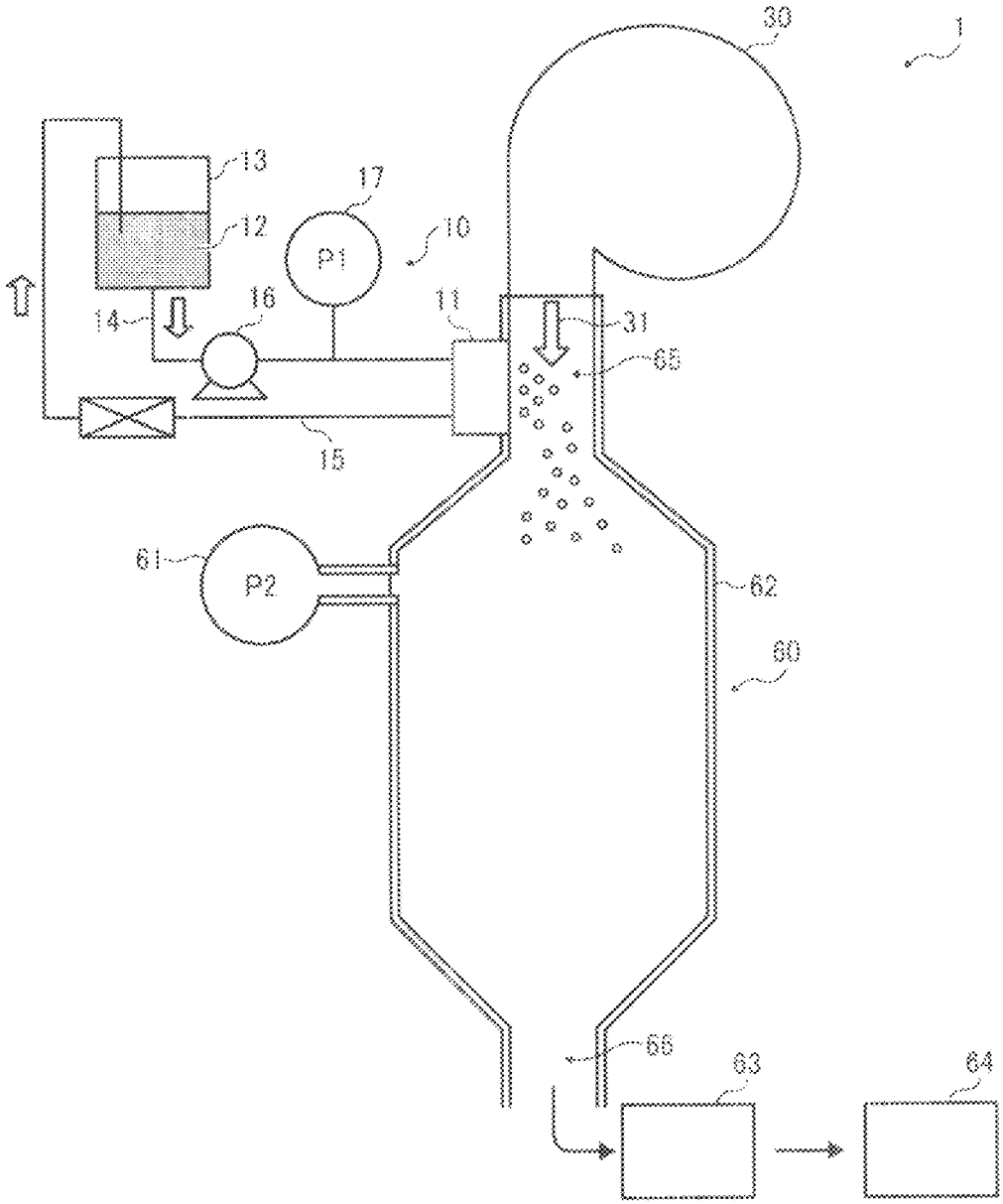
FIG. 1 is a schematic cross-sectional view illustrating an example of the toner production apparatus of the present invention.
Figure 2:
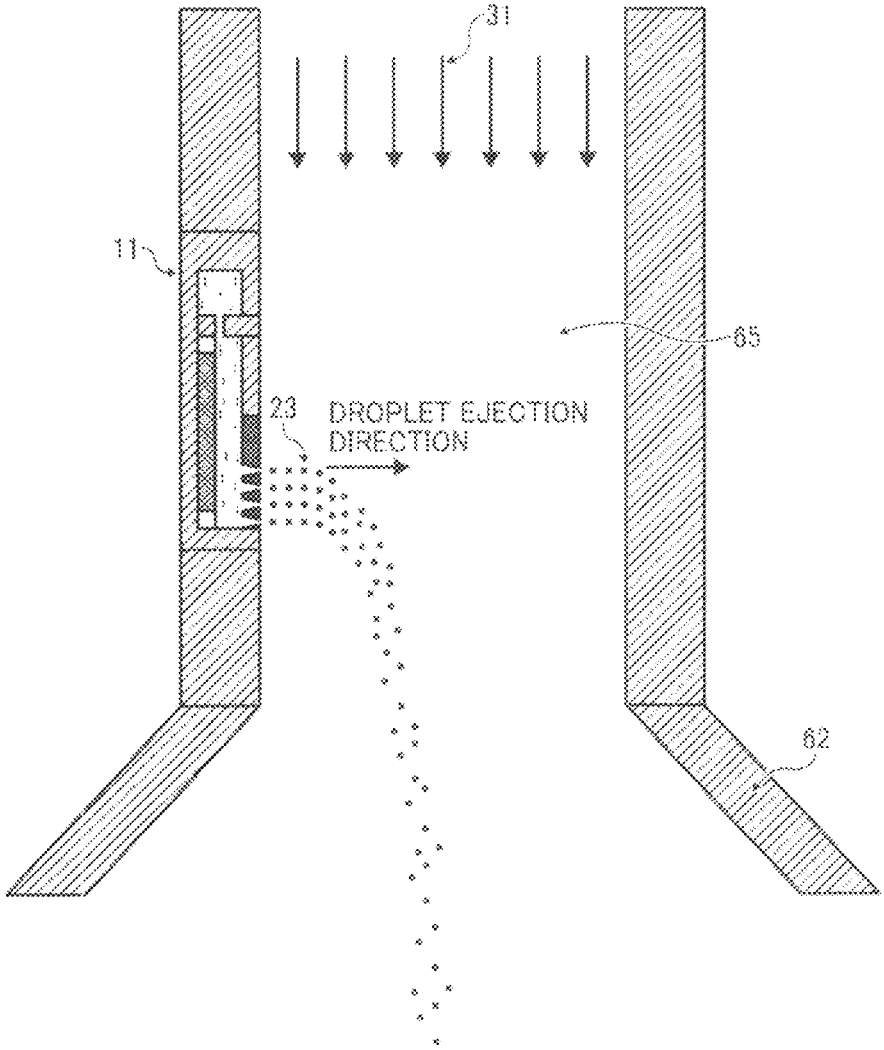
FIG. 2 is a schematic cross-sectional view illustrating a droplet ejecting unit of the toner production apparatus illustrated in FIG. 1.
Figure 3:
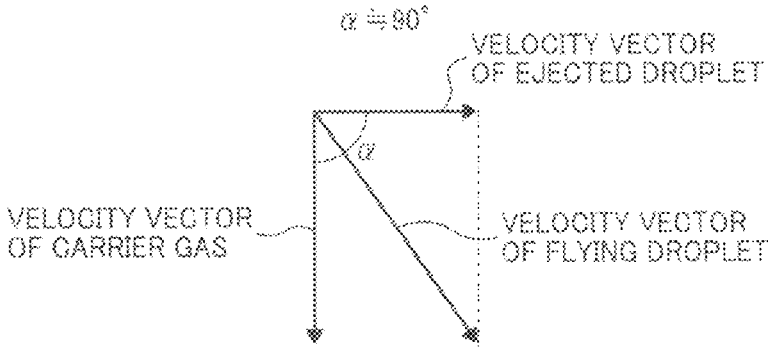
FIG. 3 is a schematic view illustrating the relation between the direction of a carrier gas and the droplet ejecting direction.
Figure 4:
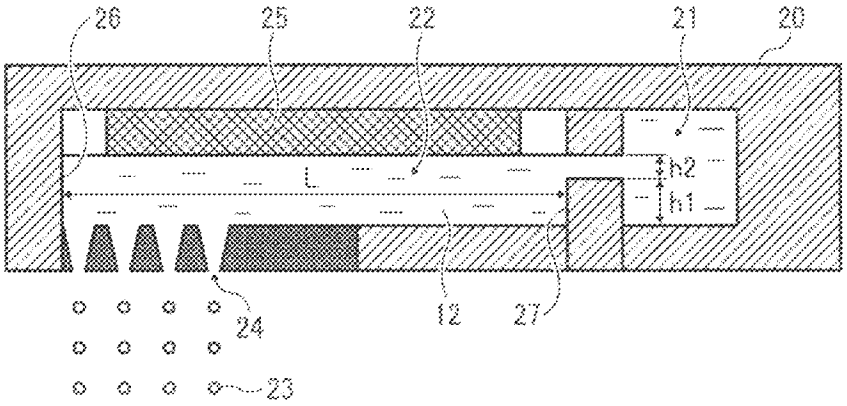
FIG. 4 is a schematic cross-sectional view illustrating the droplet ejecting head of the droplet ejecting unit illustrated in FIG. 2.
Figure 5:
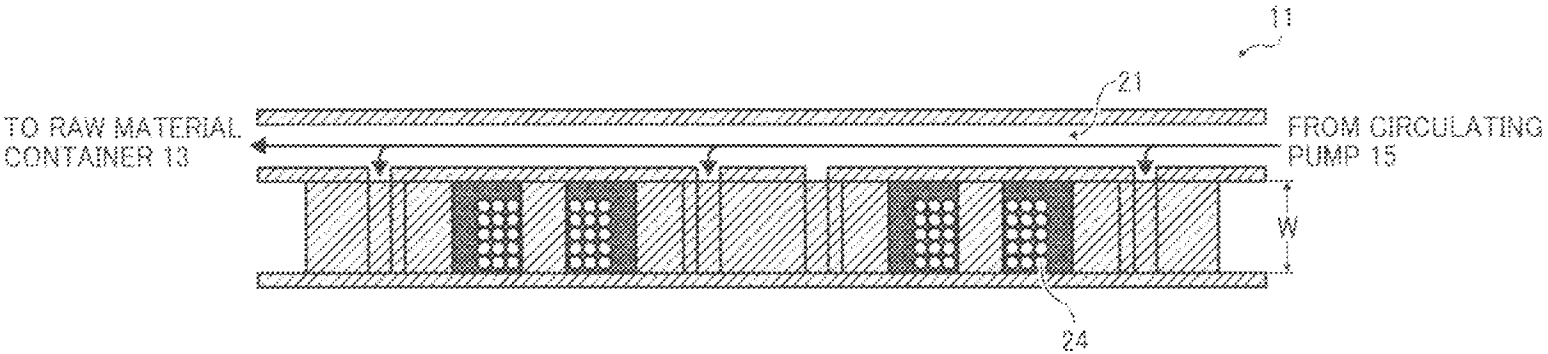
FIG. 5 is a schematic cross-sectional view illustrating the droplet ejecting unit of the toner production apparatus illustrated in FIG. 1.

FIG. 1 is a cross-sectional overall view illustrating the entire of a toner production apparatus of the present invention, and FIG. 2 is a schematic view illustrating how ejected droplets are fed by a carrier gas. FIG. 3 is a schematic view illustrating the relation between the direction of a carrier gas and the droplet ejecting direction, and FIG. 4 is a schematic cross-sectional view illustrating the droplet ejecting head of the droplet ejecting unit illustrated in FIG. 2. FIG. 5 is a schematic cross-sectional view illustrating the droplet ejecting unit of the toner production apparatus illustrated in FIG. 1.

A toner production apparatus 1 illustrated in FIG. 1 includes a droplet ejecting unit 10 and a drying and collecting unit 60 as main components. The droplet ejecting unit 10 includes a droplet ejector 11 including multiple droplet ejecting heads 20 to eject droplets of the toner composition liquid in a liquid column resonance chamber 22 (illustrated in FIG. 4) in a horizontal direction. In the liquid column resonance chamber 22, a liquid column resonance standing wave is generated under the below-mentioned conditions. As illustrated in FIG. 1, the droplet ejecting unit 10 is communicated with a toner composition liquid container 13 (i.e., a raw material container), which stores the toner composition liquid 12, through a liquid supply tube 14. A pump 16 is provided on the liquid supply tube 14 to pressure-feed the toner composition liquid 12 in the toner composition liquid container 13 to the droplet ejector 11 while pressure-feeding the toner composition liquid 12 in the droplet ejector 11 to return the toner composition liquid to the toner composition liquid container 13 through a liquid return tube 15. Thus, the toner composition liquid 12 can be supplied to the droplet ejector 11 as needed while circulated. A pressure gauge 17 is provided on the liquid supply tube 14 to measure a pressure P1 of the toner composition liquid 12 fed to the droplet ejector 11 to control the pressure P1. In addition, another pressure gauge 61 is provided on the drying and collecting unit 60 to measure a pressure P2 in the drying and collecting unit 60 to control the pressure P2. In this regard, when the pressure P1 is higher than the pressure P2, the toner composition liquid may drop from the nozzles of the droplet ejecting heads 20. In contrast, when the pressure P1 is lower than the pressure P2, air may enter into the droplet ejecting heads 20 from the drying and collecting unit 60, thereby making it impossible to eject droplets of the toner composition liquid 12 from the nozzles. Therefore, it is preferable that the pressures P1 and P2 are substantially the same.

As illustrated in FIG. 4, the droplet ejecting heads 20 includes a common liquid passage 21 and the liquid column resonance chamber 22. The liquid column resonance chamber 22 is communicated with the common liquid passage 21, which is provided on one of end walls of the liquid column resonance chamber extending in the longitudinal direction thereof. The liquid column resonance chamber 22 has another wall connected with the end walls and having droplet ejection nozzles 24 to eject droplets 23 of the toner composition liquid 12, and a vibrator 25 generating high-frequency vibration to form a liquid column resonance wave in the liquid column resonance chamber 22. The vibrator 25 is connected with a high-frequency power source.

Referring back to FIG. 1, the drying and collecting unit 60 includes a chamber 62, a toner collector 63, and a toner container 64. A carrier gas (such as air) 31 (hereinafter sometimes referred to as carrier air or airflow) is downwardly fed to the chamber 62 by a gas feeder 30 (hereinafter referred to as an air feeder) such as a blower. The flow direction of the carrier air 31 is substantially perpendicular to the droplet ejection direction. As illustrated in FIG. 3, when the direction of the carrier air 31 is substantially perpendicular to the droplet ejection direction, the droplet flight velocity can be increased, thereby making it possible to prevent uniting of the ejected droplets. Specifically, since the droplets 23 of the toner composition liquid 12 ejected from the nozzles 24 of the droplet ejector 11 are fed downward by the gravity and the downward airflow 31, the velocity of the droplets 23 is increased, thereby preventing the velocity of the droplets from being decreased due to friction between the droplets and air. In addition, since the flight direction of the droplets is changed by the carrier air 31, the distance between the droplets is increased. Therefore, occurrence of the droplet uniting problem can be prevented. In order to form the carrier air 31, a method in which a blower is provided on an upper portion of the chamber to feed air downward, a method in which air is sucked from the toner collector 63, or the like method can be used.

In this toner production apparatus 1 illustrated in FIG. 1, the droplets of the toner composition liquid are dried in the chamber 62, and therefore the chamber serves as a solidifying device to solidify the droplets. In this regard, the airflow 31 also contributes to solidifying the droplets. In order to efficiently solidifying the droplets, it is preferable to control the velocity of the airflow 31 and/or the temperature in the chamber 62. In addition, dry air other than the carrier air 31 can be optionally fed to the chamber 62 and/or a heater can be optionally set in the chamber to efficiently solidifying the droplets.

Swirling airflow swirling around a vertical axis is formed in the toner collector 63 by a swirling airflow generator. The toner particles collected by the toner collector 63 are fed to the toner container 64 through a toner collection tube connecting the chamber 62 with the toner container 64 through the toner collector 63.

The droplets 23 of the toner composition liquid 12 (i.e., liquid toner particles) ejected from the nozzles 24 toward the chamber 62 are gradually dried in the chamber as the solvent included in the droplets is evaporated (for example, by being heated), and finally solid toner particles are formed in the chamber 62. The solid toner particles are collected by the toner collector 63, and then stored in the toner container 64. The toner particles stored in the toner container 64 may be subjected to an additional drying treatment if necessary.

Next, the toner production process using the toner production apparatus will be described.

Referring to FIG. 1, the toner composition liquid 12 contained in the toner composition liquid container 13 is circulated by the pump 16 such that the toner composition liquid 12 is fed to the common liquid passage 21 of the droplet ejector 11 (illustrated in FIG. 5) through the liquid supply tube 14 so as to be supplied to the liquid column resonance chamber 22 of the droplet ejecting heads 20. In the liquid column resonance chamber 22 containing the toner composition liquid 12 therein, a pressure distribution is caused by a liquid column resonance standing wave generated by the vibrator 25. In this regard, droplets 23 of the toner composition liquid 12 are ejected from the droplet ejection nozzles 24, which are arranged at a location of the liquid column resonance chamber 22 corresponding to an antinode (i.e., maximum amplitude point) of the liquid column resonance standing wave, at which pressure largely fluctuates. In this application, the antinode of a standing wave means an area of the standing wave other than a wave node of the standing wave. It is preferable that at the area the standing wave has a large amplitude (i.e., a large pressure fluctuation) sufficient to eject droplets, and it is more preferable that the area is present in a region (hereinafter sometimes referred to as an antinode region) with a center of the maximum amplitude point of the pressure standing wave (i.e., the wave node of the velocity standing wave) while having a length of ±¼ of the wavelength of the standing wave. When the multiple droplet ejection nozzles 24 are present in the antinode region, droplets ejected from the nozzles have substantially the same particle size. In addition, since multiple nozzles can be used, droplets can be efficiently produced and the chance of occurrence of a nozzle clogging problem in that the nozzles are clogged with the toner composition liquid can be reduced.

The toner composition liquid 12 passing through the common liquid passage 21 is returned to the toner composition liquid container 13 through the liquid return tube 15. When the amount of the toner composition liquid 12 in the liquid column resonance chamber 22 is decreased due to ejection of the toner composition liquid 12 from the nozzles 24, the force of sucking the toner composition liquid is increased by the action of the liquid column resonance standing wave in the liquid column resonance chamber 22, thereby increasing the amount of the toner composition liquid supplied to the liquid column resonance chamber 22 from the common liquid passage 21. Therefore, the liquid column resonance chamber 22 is replenished with the toner composition liquid 12. When the liquid column resonance chamber 22 is replenished with the toner composition liquid 12, the flow rate of the toner composition liquid flowing through the common liquid passage 21 increases so as to be the normal flow rate, and circulation of the toner composition liquid from the container 13 to the container through the liquid supply tube 14 and the liquid return tube 15 is normalized.

The liquid column resonance chamber 22 is preferably constituted of frames, which are connected with each other and which are made of a material having a high rigidity (such as metals, ceramics and silicon) such that the resonance frequency of the toner composition liquid in the liquid column resonance chamber 22 is not affected by the frames. In addition, as illustrated in FIG. 4, a length L between two opposed longitudinal end walls 26 and 27 of the liquid column resonance chamber 22 is determined based on the liquid column resonance principle mentioned below. Further, a width W (illustrated in FIG. 5) of the liquid column resonance chamber 22 is preferably not greater than ½ of the length L so as not to apply an extra frequency, by which the liquid column resonance is influenced. Furthermore, it is preferable to provide multiple liquid resonance chambers in one droplet ejecting unit to dramatically improve the productivity of the toner. The number of liquid resonance chambers in one droplet ejecting unit 10 is preferably from 100 to 2,000 so that the toner production apparatus has a good combination of productivity and operationality. In this case, each of the liquid resonance chambers is connected with the common liquid passage 21.

The vibrator 25 of the droplet ejecting head 20 is not particularly limited as long as the vibrator can be vibrated at a predetermined frequency, but a material in which a piezoelectric material is laminated to an elastic plate is preferably used. In this regard, the elastic plate prevents the piezoelectric material form being contacted with the toner composition liquid and constitutes part of the wall of the liquid column resonance chamber. Specific examples of the materials for use as the piezoelectric material include piezoelectric ceramics such as lead zirconate titanate (PZT). However, in general displacement of such a material is small, and therefore laminated materials in which several piezoelectric materials are laminated are typically used. In addition, other piezoelectric materials such as polyvinylidene fluoride (PVDF) and single crystals (e.g., quart, $LiNbO_3$, $LiTaO_3$, and $KNbO_3$) can also be used. The vibrator 25 is preferably arranged in each liquid column resonance chamber 22 to control vibration of the chamber. In addition, the vibrator 25 preferably has a structure such that a block of a vibrating member is set in the entire of the liquid column resonance chambers while partially cut so as to be arranged in each liquid column resonance chamber so that vibration of each liquid column resonance chamber can be separately controlled via an elastic plate.

The diameter of each of the droplet ejection nozzles 24 is preferably from 1 μm to 40 μm. When the diameter is less than 1 μm, the diameter of ejected droplets becomes too small, and therefore toner particles having a desired particle diameter cannot be produced. In addition, when the toner composition liquid includes a particulate material, the nozzle clogging problem is often caused, thereby deteriorating the productivity. In contrast, when the diameter is greater than 40 μm, the diameter of ejected droplets becomes too large. When toner particles having a diameter of from 3 μm to 6 μm are prepared using such large droplets, the toner composition liquid has to have a low solid content (i.e., the toner composition liquid has to include a large amount of solvent), and a large amount of energy is necessary for drying the ejected droplets, resulting in deterioration of productivity and increase of production costs.

The droplet ejection nozzles 24 are preferably arranged so as to extend in the width direction of the liquid column resonance chamber 22 as illustrated in FIG. 4 because the number of nozzles can be increased, thereby raising the production efficiency. Since the liquid column resonance frequency changes depending on the arrangement of the droplet ejection nozzles 24, it is preferable to properly determine the liquid column resonance frequency by checking whether desired droplets are ejected from the nozzles 24.

Next, the mechanism of forming droplets in the droplet ejecting unit of the toner production apparatus will be described.

Initially, the principle of the liquid column resonance phenomenon caused in the liquid column resonance chamber 22 of the droplet ejecting heads 20 will be described. The wavelength (λ) of resonance of the toner composition liquid in the liquid column resonance chamber 22 is represented by the following equation (1):

$$\lambda = c/f \quad (1),$$

wherein c represents the acoustic velocity in the toner composition liquid, and f represents the frequency of vibration applied to the toner composition liquid by the vibrator 25.

As illustrated in FIG. 4, the length between the end wall 26 of the liquid column resonance chamber 22 to the other end wall 27 closer to the common liquid passage 21 is L, and the end wall 27 has a height of h1 while the opening communicating the liquid column resonance chamber 22 with the common liquid passage 21 has a height of h2. When the height h1 is twice the height h2 (e.g., h1 is about 80 μm, and h2 is about 40 μm) and it is provided that both the end walls are closed (i.e., the chamber 22 has two fixed ends), resonance can be formed most efficiently if the length L satisfied the following equation (2):

$$L = (N/4)\lambda \quad (2),$$

wherein n represents an even number.

In a chamber having two open ends, the above-mentioned equation (2) is also satisfied. Similarly, in a chamber having one fixed end and one open end, resonance can be formed most efficiently when N is an odd number in equation (2).

The frequency of vibration f (most efficient frequency) at which the resonance can be formed most efficiently is obtained from the following equation (3), which is obtained from equations (1) and (2):

$$f = N \times c/(4L) \quad (3).$$

However, since liquids have viscosity, the resonance is decayed, and vibration is not endlessly amplified. Namely, a liquid has a Q value, and the liquid can cause resonance at a frequency in the vicinity of the above-mentioned most efficient frequency f represented by equation (3).

FIGS. 6A-6D illustrate standing waves (in a resonance mode) of velocity fluctuation and pressure fluctuation when N is 1, 2 or 3. FIGS. 7A-7C illustrate standing waves (in a resonance mode) of velocity fluctuation and pressure fluctuation when N is 4 or 5. In reality, each of the waves is a compression wave (longitudinal wave), but is generally illustrated as the waves in FIGS. 6 and 7. In FIGS. 6 and 7, a velocity standing wave is illustrated by a solid line, and a pressure standing wave is illustrated by a broken line.

Figure 6A:
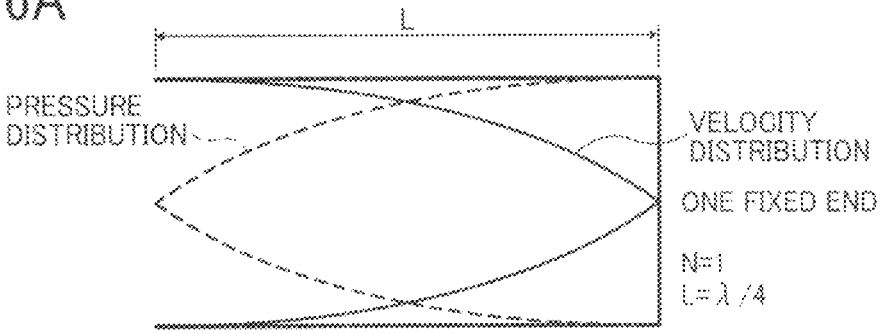
FIGS. 6A-6D are schematic views illustrating the velocity distribution and pressure distribution of standing waves formed when N=1, 2 or 3.

For example, in a case illustrated in FIG. 6A in which the liquid column resonance chamber has one fixed end and N is 1, the frequency of the velocity distribution becomes zero at the closed end, and has a maximum value at the open end. When the length of the liquid column resonance chamber is L, the wavelength of resonance is λ, and N is 1, 2, 3, 4 or 5, the standing wave can be formed most efficiently. Since the shape of the standing wave changes depending on the states (i.e., opened or closed state) of both the ends of the liquid column resonance chamber, both the cases are illustrated in FIGS. 6 and 7. As mentioned later, the states of the ends are determined depending on the conditions of the openings of the droplet ejection nozzles 24 and the opening connecting the liquid column resonance chamber 22 with the common liquid passage 21. In acoustics, an open end means an end at which the moving velocity of a medium (liquid) becomes zero, and the pressure is maximized. In contrast, at a closed end, the moving velocity of a medium is maximized. The closed end is considered to be a hard wall in acoustics, and reflection of a wave is caused. When the liquid column resonance chamber has an ideal open end and/or an ideal closed end as illustrated in FIGS. 6 and 7, such resonance standing waves as illustrated in FIGS. 6 and 7 are formed due to overlapping of waves. However, the shape of the standing waves is changed depending on the number of the droplet ejection nozzles 24 and the positions of the nozzles, and therefore the most efficient frequency f may be slightly different from that obtained from equation (3). In such a case, by adjusting the drive frequency, stable ejection conditions can be established. For example, in a case where the acoustic velocity c is 1,200 m/s in the liquid, the length L of the chamber is 1.85 mm, both the ends are closed ends (wall), and the resonance mode is an N=2 mode, the most efficient frequency f is determined as 324 kHz from equation (2). In addition, in a case where the acoustic velocity c is 1,200 m/s in the liquid, the length L of the chamber is 1.85 mm, both the ends are closed ends (wall), and the resonance mode is an N=4 mode, the most efficient frequency f is determined as 648 kHz from equation (2). In the latter case, higher-degree resonance can be used than in the former case.

The liquid column resonance chamber 22 of the droplet ejecting heads 20 illustrated in FIGS. 1 and 4 is preferably equivalent to a chamber having two closed ends to increase the most efficient frequency. Alternatively, it is also preferable for increasing the most efficient frequency that the wall having the droplet ejection nozzles 24 serves as an acoustically soft wall due to the openings of the nozzles. However, the liquid column resonance chamber 22 is not limited thereto, and can have two open ends. In this regard, the influence of the openings of the droplet ejection nozzles is such that the acoustic impedance is decreased thereby while the compliance is increased thereby. Therefore, the liquid column resonance chamber 22 preferably has a structure equivalent to the structure (two closed ends) illustrated in FIG. 6B or 7A because both the resonance mode in the two closed ends structure and the resonance mode in the one open end structure in which the wall on the nozzle side is considered to be an open end can be used.

When the drive frequency is determined, other factors such as the number of openings (nozzles), the positions of the openings and the cross-sectional shape of the openings should also be considered. For example, when the number of openings is increased, the fixed end of the liquid column resonance chamber is loosely bounded so as to be similar to an open end, and the standing wave becomes similar to a standing wave formed in a chamber having one open end, resulting in increase of the drive frequency. In this regard, the wall of the liquid column resonance chamber having the nozzles is loosely restricted from the position of the opening (nozzle) closest to the end 27 of the chamber closer to the common liquid supply 21. In addition, when the nozzles 24 have a round cross-section, and the volume of the nozzles varies depending on the thickness of the frame of the chamber having the nozzles, the real standing wave has a shorter wavelength, and therefore the frequency of the wave becomes higher than the drive frequency. When a voltage is applied to the vibrator to generate the thus determined drive frequency (most efficient drive frequency), the vibrator is deformed and thereby a resonance standing wave can be generated most efficiently. In this regard, a resonance standing wave can also be generated at a drive frequency in the vicinity of the most efficient drive frequency. When the length of the liquid column resonance chamber 22 in the longitudinal direction is L, and the length between the end wall 27 of the chamber closer to the common liquid supply 21 and the nozzle closest to the end wall is Le, droplets of the toner composition liquid 12 can be ejected from the nozzles by liquid column resonance caused by vibrating the vibrator using a drive wave including, as a main component, a drive frequency f in the range represented by the following relationships (4) and (5):

$$N\times c/(4L)\leq f\leq N\times c/(4Le) \quad (4),$$

and $$N\times c/(4L)\leq f\leq (N+1)\times c/(4Le) \quad (5).$$

The ratio (Le/L) of the length Le to the length L is preferably greater than 0.6.

As mentioned above, by using the liquid column resonance phenomenon, a liquid column resonance standing wave of pressure is formed in the liquid column resonance chamber 22 illustrated in FIG. 4, thereby continuously ejecting droplets of the toner composition liquid from the liquid ejection nozzles 24 of the liquid column resonance chamber. In this regard, it is preferable that the liquid ejection nozzles 24 are formed on a position, at which the pressure of the standing wave varies most largely, because the droplet ejecting efficiency is enhanced, and thereby the liquid ejection unit 10 can be driven at a low voltage.

Although it is possible for the liquid column resonance chamber 22 to have only one liquid ejection nozzle, it is preferable for the chamber to have multiple liquid ejection nozzles, preferably from 2 to 100 nozzles, to enhance the productivity. When the number of nozzles is greater than 100, the voltage applied to the vibrator 25 has to be increased in order to form droplets having a desired particle diameter. In this case, the piezoelectric material serving the vibrator tends to operate unstably. The distance between two adjacent nozzles is preferably not less than 20 μm and less than the length L of the liquid column resonance chamber 22. When the distance between two adjacent nozzles is less than 20 μm, the chance of collision of droplets ejected from the two adjacent nozzles is increased, thereby forming united particles, resulting in deterioration of the particle diameter distribution of the resultant toner.

Figure 6B:
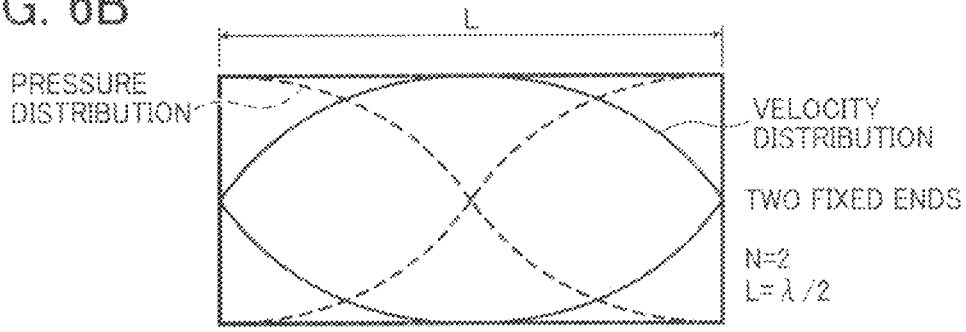
Figure 6C:
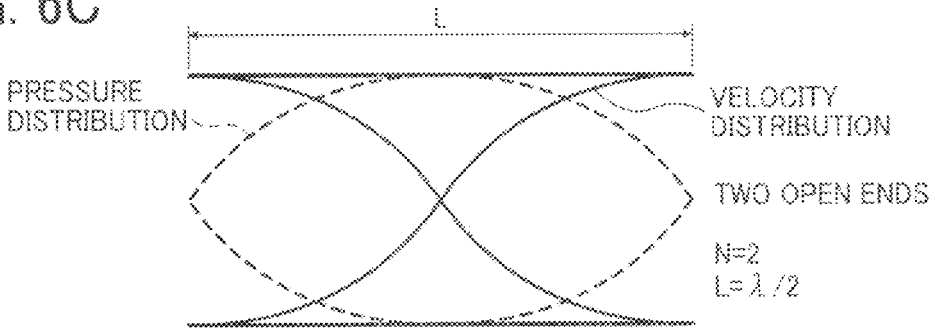
Figure 6D:
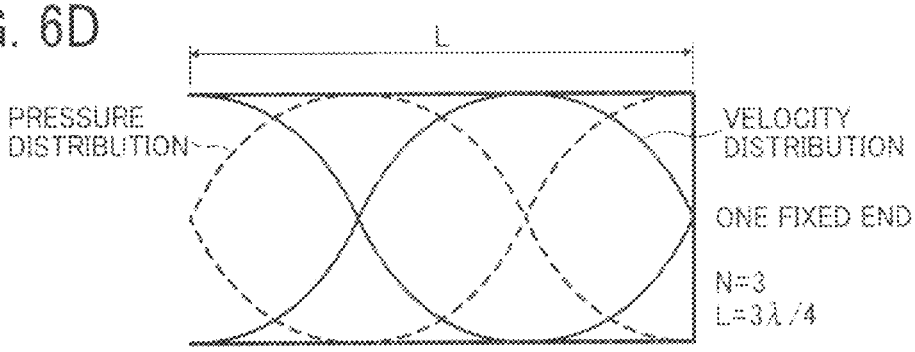
Figure 7A:
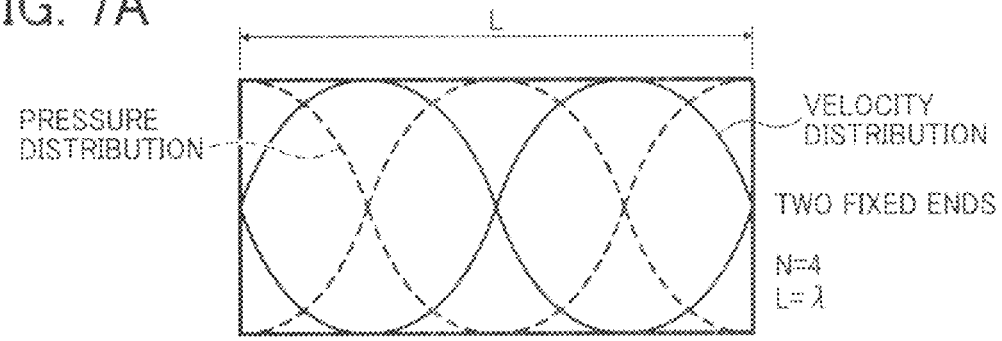
FIGS. 7A-7C are schematic views illustrating the velocity distribution and pressure distribution of standing waves formed when N=5 or 6.
Figure 7B:
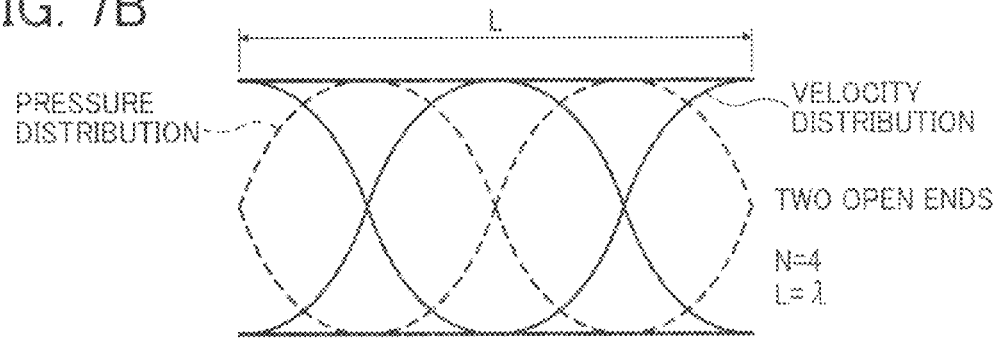
Figure 7C:
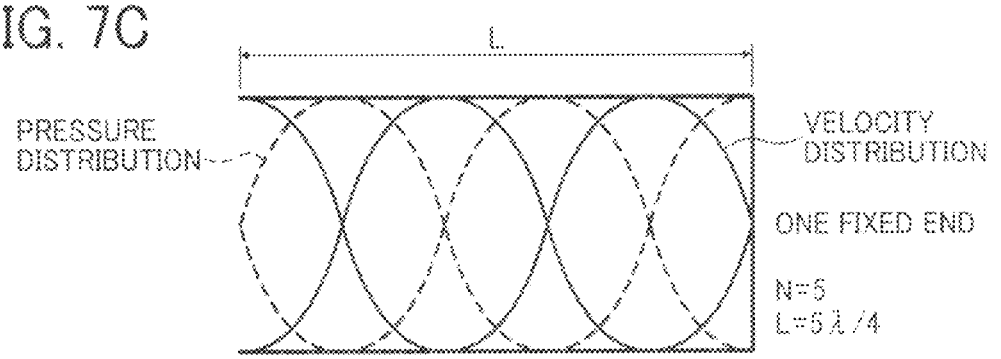

Next, the liquid column resonance phenomenon caused in the liquid column resonance chamber 22 will be described by reference to FIGS. 8A-8D. In FIGS. 8A-8D, a solid line represents the velocity distribution of the toner component liquid 12 at any position of from the fixed end wall to the other end wall near the common liquid passage 21. In this regard, when the solid line is present in a positive (+) region, the toner component liquid 12 is fed from the common liquid passage 21 toward the liquid column resonance chamber 22. When the solid line is present in a negative (−) region, the toner component liquid 12 is fed from the liquid column resonance chamber 22 toward the common liquid passage 21. A broken line represents the pressure distribution of the toner component liquid 12 at any position of from the fixed end wall to the other end wall near the common liquid passage 21. In this regard, when the broken line is present in a positive (+) region, the pressure in the chamber 22 is higher than atmospheric pressure (i.e., the pressure is a positive pressure). When the broken line is present in a negative (−) region, the pressure is lower than atmospheric pressure. Specifically, when the pressure is a positive pressure, a downward pressure is applied to the toner component liquid 12. When the pressure is a negative pressure, an upward pressure is applied to the toner component liquid 12. In this regard, since the height (h1) of the fixed wall 27 of the liquid column resonance chamber 22 is about twice the height (h2) of the opening connecting the chamber 22 with the common liquid passage 21, the velocity distribution curve and the pressure distribution curve are obtained while assuming that the liquid column resonance chamber 22 has two fixed ends as illustrated in FIG. 6B.

Figure 8A:
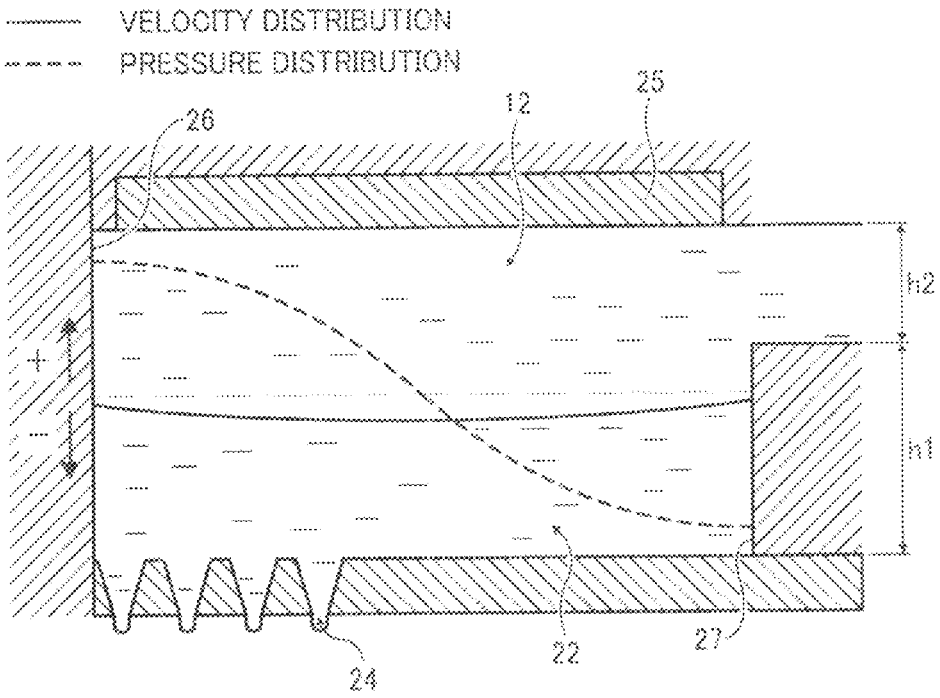
FIGS. 8A-8D are schematic views illustrating how liquid column resonance is caused in a liquid column resonance chamber of the droplet ejecting unit.
Figure 8B:
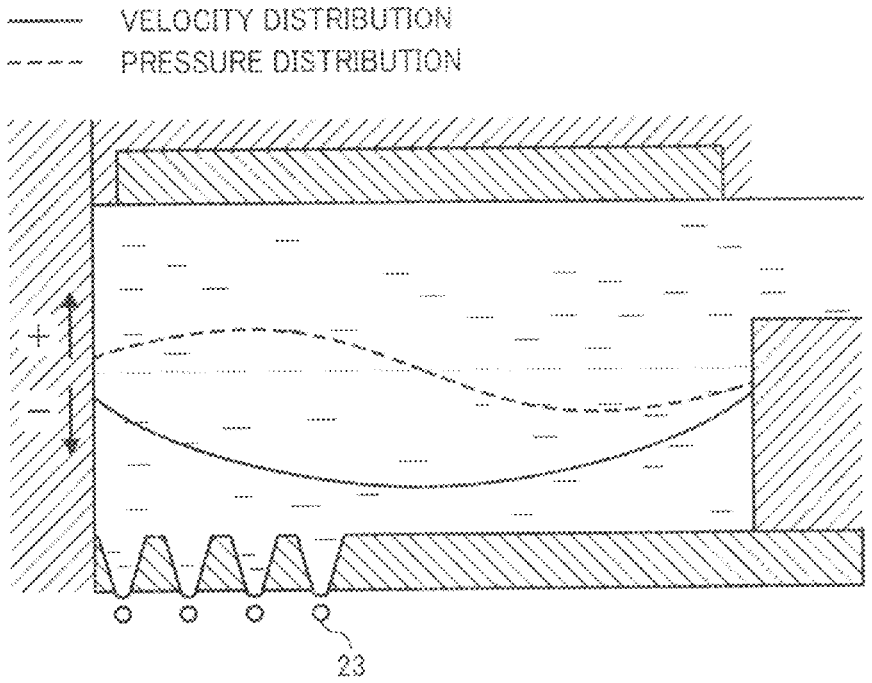

FIG. 8A illustrates the pressure waveform and the velocity waveform in the liquid column resonance chamber 22 just after droplets are ejected from the droplet ejection nozzles 24. As illustrated in FIG. 8A, the pressure in a portion of the toner component liquid 12 above the nozzles 24 in the liquid column resonance chamber 22 is maximized. In FIG. 8A, the flow direction of the toner component liquid 12 in the liquid column resonance chamber 22 is the direction of from the nozzles 24 to the common liquid passage 21 and the velocity thereof is low. Next, as illustrated in FIG. 8B, the positive pressure in the vicinity of the nozzles 24 is decreased, so that the pressure is changed toward a negative region (pressure). In this case, the flow direction of the toner component liquid 12 is not changed, but the velocity of the toner component liquid is maximized, thereby ejecting droplets of the toner component liquid.

Figure 8C:
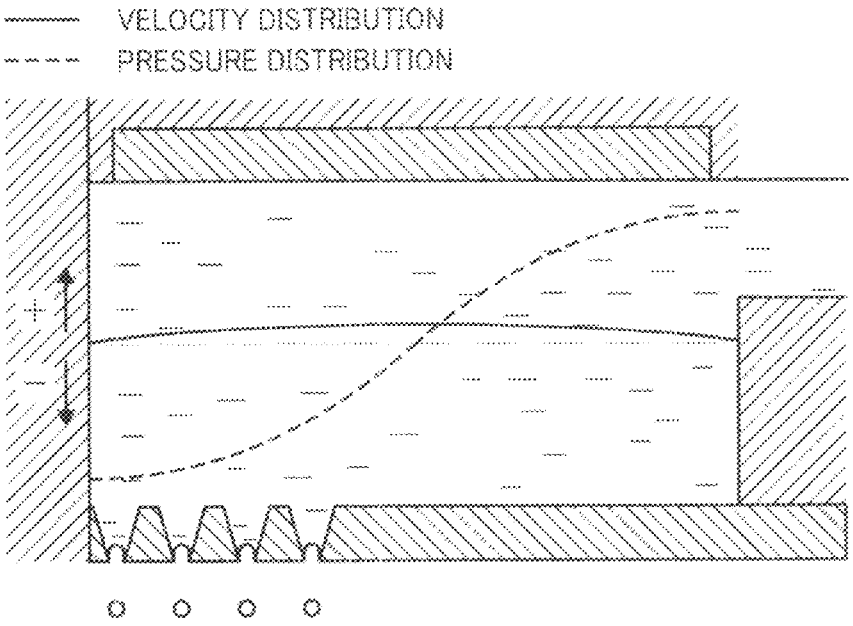
Figure 8D:
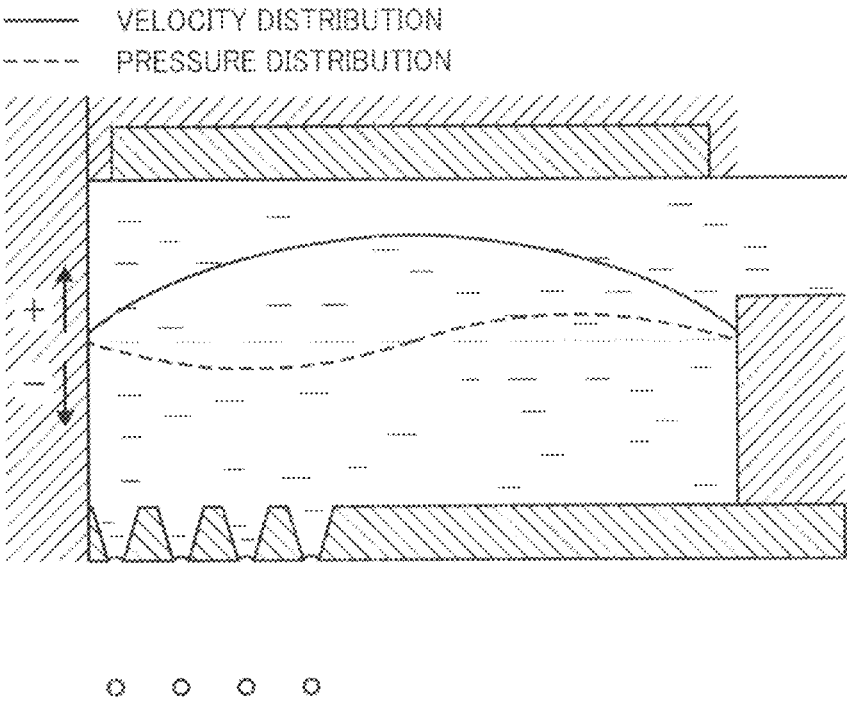

After droplets are ejected, the pressure in the vicinity of the droplet ejection nozzles 24 is minimized (i.e., maximized in the negative region) as illustrated in FIG. 8C. In this case, feeding of the toner component liquid 12 to the liquid column resonance chamber 22 from the common liquid passage 21 is started. Next, as illustrated in FIG. 8D, the negative pressure in the vicinity of the nozzles 24 is decreased, so that the pressure is changed toward a positive pressure. Thus, the liquid filling operation is completed. Next, the positive pressure in the liquid column resonance chamber 22 is maximized as illustrated in FIG. 8A, and then the droplets 23 of the toner component liquid 12 are ejected as illustrated in FIG. 8B.

Thus, since a liquid column resonance standing wave is formed in the liquid column resonance chamber 22 by driving the vibrator with a high frequency wave, and in addition, the droplet ejection nozzles 24 are arranged at a location corresponding to the antinode of the standing wave at which the pressure varies most largely, the droplets 23 of the toner component liquid 12 can be continuously ejected from the droplet ejection nozzles 24.

Figure 9:
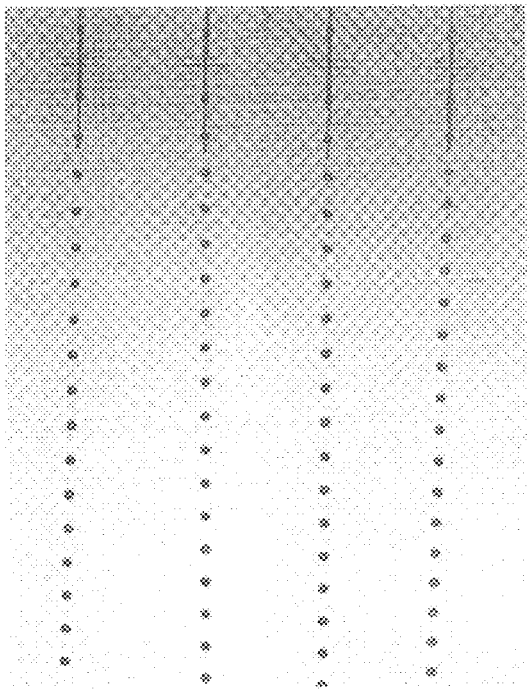
FIG. 9 is a photograph of droplets ejected from the droplet ejecting unit, which is taken a laser shadowgraphy method.

An experiment on this droplet ejection operation was performed. Specifically, in the droplet ejecting head 20 used for this experiment, the length (L) of the liquid column resonance chamber 22 is 1.85 mm, and N is 2. In addition, the droplet ejection nozzles 24 have four nozzles (i.e., first to fourth nozzles) at a location corresponding to the antinode of the pressure standing wave in the N=2 mode. Further, a sine wave having a frequency of 340 kHz is used to eject droplets of a toner composition liquid. FIG. 9 is a photograph, which is taken by using a laser shadowgraphy method and which shows droplets of the toner composition liquid ejected from the four nozzles. It can be understood from FIG. 9 that droplets having substantially the same particle diameter can be ejected from the four nozzles at substantially the same velocity.

Figure 10:
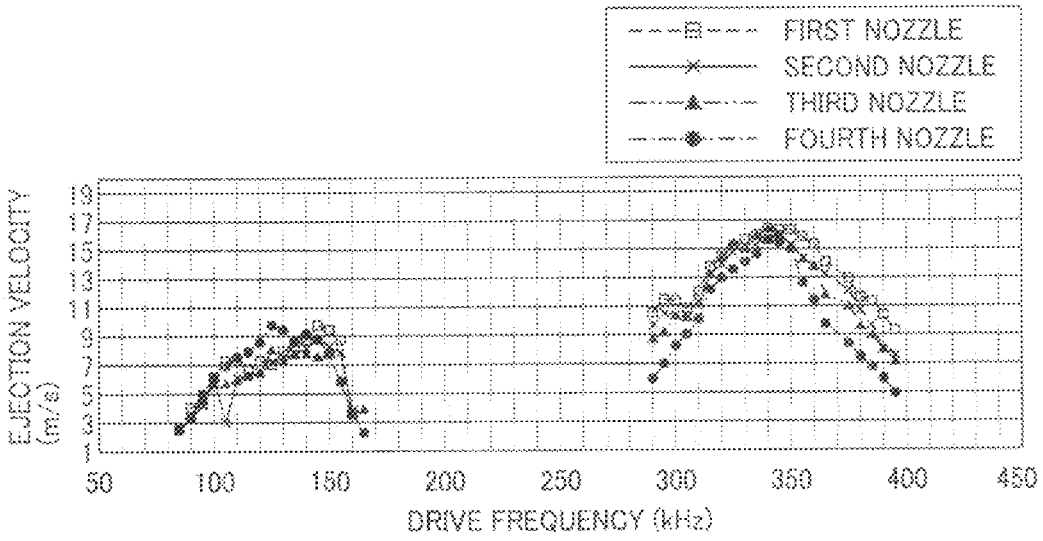
FIG. 10 is a graph showing the relation between the drive frequency of vibration and the velocity of ejected droplets.

FIG. 10 is a graph showing the velocity of droplets ejected from the first to fourth nozzles when using a sine wave with a drive frequency in a range of from 290 kHz to 395 kHz. It can be understood from FIG. 10 that at the frequency of 340 kHz, the velocities of droplets ejected from the first to fourth nozzles are substantially the same while the velocities are maximized. Namely, it could be confirmed that droplets of the toner composition liquid are evenly ejected from the antinode of the liquid column resonance standing wave when the second mode is used (i.e., when the liquid column resonance frequency is 340 kHz). In addition, the velocities of droplets ejected from the first to fourth nozzles when the first mode is used (i.e., when the liquid column resonance frequency is 130 kHz) are shown on the left side of the graph (FIG. 10). It can also be understood from FIG. 10 that droplets are not ejected between the first mode (130 kHz) and the second mode (340 kHz). This frequency characteristic is specific to liquid column resonance standing waves, and therefore it was confirmed that liquid column resonance occurs in the chamber 22.

Figure 11:
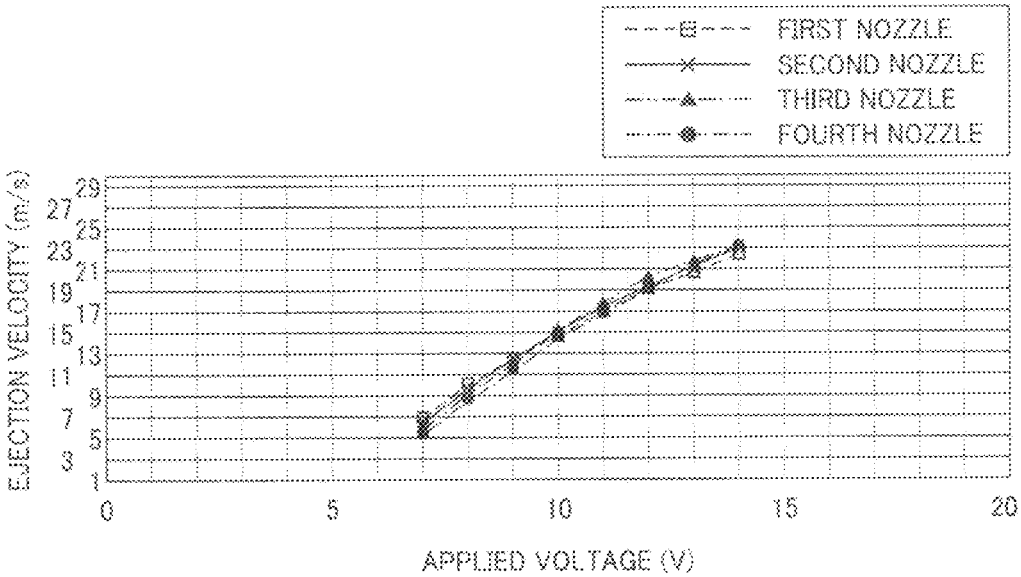
FIG. 11 is a graph showing the relation between the voltage applied to nozzles and the velocity of droplets ejected from the nozzles.
Figure 12:
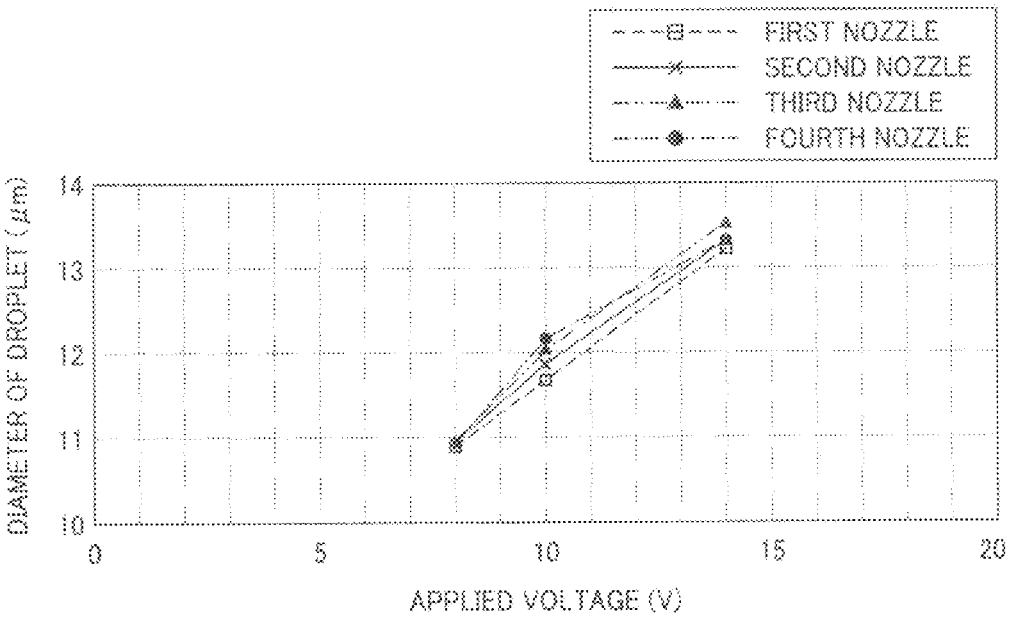
FIG. 12 is a graph showing the relation between the voltage applied to nozzles and the particle diameter of droplets ejected from the nozzles.

FIG. 11 is a graph showing the relation between the voltage applied to the vibrator and the droplet ejection velocity in each of the first to fourth nozzles, and FIG. 12 is a graph showing the relation between the applied voltage and the diameter of droplets ejected from each of the first to fourth nozzles. It can be understood from FIGS. 11 and 12 that both the velocity and the particle diameter of the droplets monotonically increase. Thus, the ejection velocity and the particle diameter of droplets depend on the applied voltage. Namely, by adjusting the applied voltage, the velocity or the particle diameter of the droplets can be adjusted, and therefore toner particles having a desired particle diameter can be stably produced.

Figure 13:
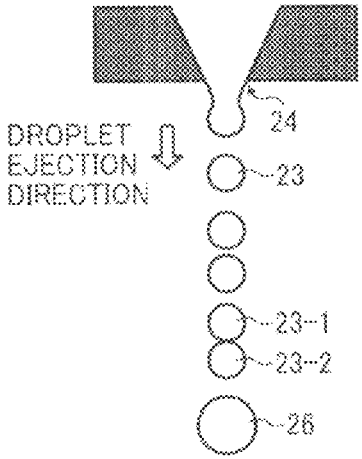
FIG. 13 is a schematic view illustrating how ejected droplets of a toner composition liquid are united.
Figure 14:
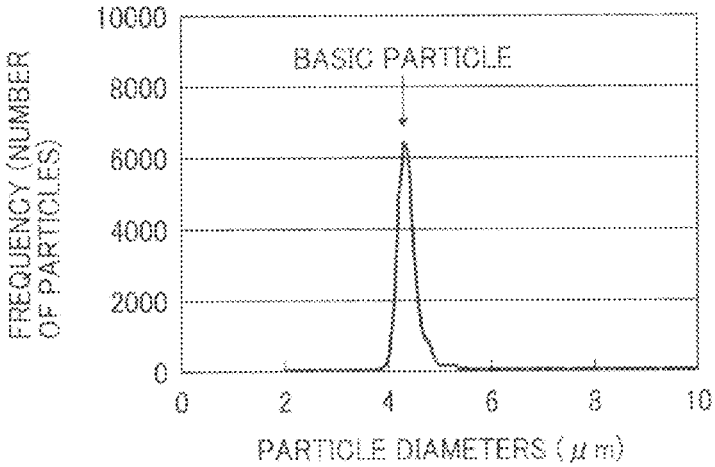
FIG. 14 is a graph showing the particle diameter distribution of a toner which is substantially constituted of basic particles.
Figure 15:
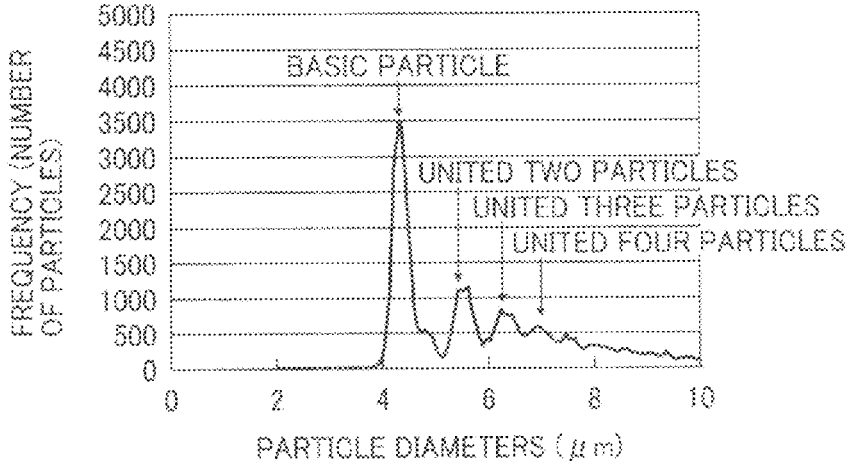
FIG. 15 is a graph showing the particle diameter distribution of a toner in a case where uniting of ejected droplets is caused.

When droplets of the toner composition liquid are ejected from the droplet ejector 11, there is a case where two (or more) of the droplets 23 ejected from the nozzles 24 are united to form a united droplet 26 as illustrated in FIG. 13. When such a united droplet is formed, the resultant toner particle has a large particle diameter, thereby widening the particle diameter distribution of the resultant toner particles. The mechanism of uniting of droplets is considered to be that before a first droplet (23-1 in FIG. 13) ejected from the nozzle 24 is dried, the velocity of the first droplet is decreased due to viscosity resistance of air, and the following droplet (23-2 in FIG. 13) is contacted with the first droplet 23-1, resulting in formation of the united droplet 26. The particle diameter distribution of a toner obtained by drying droplets including such a united particle is illustrated in FIG. 15. In this regard, since such a united droplet receives higher air resistance than a single droplet, the united droplet 26 tends to be further united with another droplet, thereby forming united droplets in which three or more droplets are united. When droplets including such larger droplets are dried, the resultant toner has a wider particle diameter distribution. FIG. 15 illustrates the particle diameter distribution of a toner including such larger toner particles. In FIG. 15, the highest peak is specific to toner particles (basic toner particles) obtained by drying single droplets without united droplets. The second highest peak is specific to toner particles obtained by drying united two droplets. Similarly, the third and fourth highest peaks are specific to toner particles obtained by drying united three or four droplets. It can be understood from FIG. 15 that there are toner particles obtained by drying united five or more droplets. This particle diameter distribution of a toner can be determined using a flow particle image analyzer FPIA-3000 from Sysmex Corp.

Figure 16:
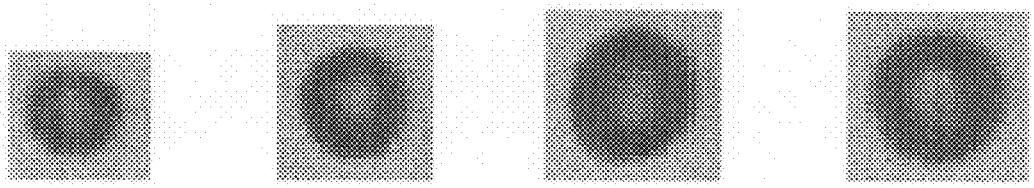
FIG. 16 is photographs of a basic particle and united particles taken by a flow particle image analyzer.
Figure 17:
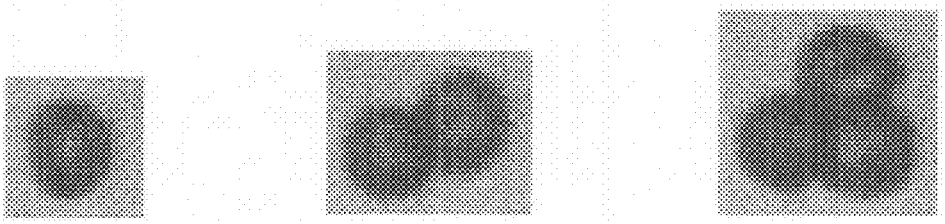
FIG. 17 is photographs of a basic particle and aggregated particles taken by a flow particle image analyzer.

Photographs of united toner particles such as united two, three and four particles are shown in FIG. 16. Photographs of aggregated particles such as aggregated two, three and four particles are shown in FIG. 17. Since such aggregated toner particles cannot be separated from each other even when a mechanical force is applied thereto, the aggregated toner particles serve as large toner particles, and are not preferable. These aggregated toner particles are typically formed when single droplets, which are dried to a certain extent, are contacted with each other. Specifically, a semi-dried single droplet, which is dried to a certain extent, is adhered to a wall of the chamber 62 or a feed pipe, and then another semi-dried single droplet is adhered thereto. After the aggregated droplets are dried, the resultant aggregated particles are separated from the chamber or the feed pipe, resulting in formation of aggregated toner particles. In order to prevent formation of such aggregated toner particles, it is preferable to quickly dry the ejected droplets or to control airflow in the toner production apparatus to prevent the ejected droplets from being adhered to a chamber or a feed pipe.

The particle diameter distribution of a particulate material is typically represented by a ratio (Dv/Dn) of the volume average particle diameter (Dv) to the number average particle diameter (Dn) of the particulate material. The ratio (Dv/Dn) is 1.0 at minimum. In this case, all the particles have the same particle diameter. As the ratio (Dv/Dn) increases, the particulate material has a wider particle diameter distribution. Toner prepared by a pulverization method typically has a ratio (Dv/Dn) of from 1.15 to 1.25, and toner prepared by a polymerization method typically has a ratio (Dv/Dn) of from 1.10 to 1.15. It was confirmed that when the toner prepared by the toner production method of the present invention has a ratio (Dv/Dn) of not greater than 1.15, high quality toner images can be produced. The ratio (Dv/Dn) is more preferably not greater than 1.10.

In electrophotography, it is preferable to use a toner having as narrow particle diameter distribution as possible because the image developing process, image transferring process and image fixing process can be satisfactorily performed. Therefore, in order to stably produce high definition images, the Dv/Dn ratio of the toner is preferably not greater than 1.15, and more preferably not greater than 1.10.

In this example, in order to prevent formation of united droplets, the droplet ejector 11 is arranged at a location between the chamber 62 and the entrance of the carrier air 31 in such a manner that the droplet ejection direction is substantially perpendicular to the flow direction of the carrier air 31.

The present inventors observe behavior of ejected droplets in a range of from the nozzles to a position apart from the nozzles by 2 mm using a laser shadowgraphy method, which has not been performed until now. As a result of the observation, it is found that uniting of droplets is caused even in such a near-nozzle range. In order to prevent uniting of droplets in such a range, the droplet ejector 11 is arranged so as to eject droplets in a direction perpendicular to the flow direction of the carrier air 31. As a result, it was confirmed that the number of united particles can be dramatically reduced by this method. Specifically, as illustrated in FIG. 3, when the direction of the carrier air 31 is substantially perpendicular to the droplet ejection direction, the droplet flight velocity can be increased, thereby making it possible to prevent uniting of the ejected droplets. Specifically, since the droplets 23 of the toner composition liquid 12 ejected from the nozzles 24 of the droplet ejector 11 are fed downward by the gravity and the downward airflow 31, the velocity of the droplets 23 is increased, thereby preventing the velocity of the droplets from being decreased due to friction between the droplets and air. In addition, since the flight direction of the droplets is changed by the carrier air 31, the distance between adjacent droplets increases. Therefore, occurrence of the droplet uniting problem can be prevented, and toner having a sharp particle diameter distribution can be produced.

The carrier air 31 has to have such a velocity as to change the moving direction of the ejected droplets 23, and the velocity is preferably not less than 7 m/s, and more preferably not less than 15 m/s. When the velocity is less than 7 m/s, there is a case where two adjacent droplets are contacted and united before the moving direction of the droplets is changed by the carrier air 31, thereby widening the particle diameter distribution of the resultant toner.

The initial velocity ($V_0$) of the droplets 23 preferably satisfies the following relationship:

$$V_0 \geq 2d_0 \times f, \text{ and more preferably } V_0 > 3d_0 \times f,$$

wherein $d_0$ represents the diameter of the droplet just after being ejected, and f represents the drive frequency.

When $V_0 < 2d_0 \times f$, the distance between two adjacent droplets is shortened, and therefore two adjacent droplets are easily contacted and united before the moving direction of the droplets is changed by the carrier air 31. The diameter of the ejected droplet 23 and the ejection velocity can be adjusted by adjusting the diameter of the nozzles, the drive frequency and the voltage applied to the vibrator 25.

In FIG. 2, the droplet ejector 11 ejects droplets 23 of the toner composition liquid in substantially a horizontal direction, but the droplet ejection direction is not limited to the horizontal direction. The droplet ejection angle can be set to a proper angle. In order to generate the carrier air 31, a method in which a blower is provided on an upper portion of an entrance 65 of the chamber 62 to feed air downward, or a method in which air is sucked from an exit 66 of the chamber 62, can be used. Specific examples of the toner collector 63 include cyclones, bag filters and the like.

The airflow 31 is not particularly limited as long as the airflow 31 can prevent uniting of ejected droplets, and may laminar flow, swirling flow, or turbulent flow. In addition, the gaseous material constituting the carrier gas 31 is not particularly limited, and is typically air or an inert gas such as a nitrogen gas.

Since droplets of a toner composition liquid have a property such that after the droplets are dried, united particles are not formed, the ejected droplets are preferably dried as quickly as possible. Therefore, the content of the gas of the solvent, which is included in the droplets, in the chamber 62 is preferably as low as possible. In addition, the temperature of the carrier air 31 is preferably adjustable, and it is preferable that the temperature of the carrier air 31 is not changed during the toner production process. It is possible to provide a device for changing the conditions of the airflow 31 in the chamber 62. The airflow 31 may be used not only for preventing the ejected droplets from being united but also for preventing the ejected droplets from being adhered to an inner wall of the chamber 62.

When the content of a residual solvent remaining in the toner particles in the toner collector 63 is high, the toner particles may be subjected to a second drying treatment. Any known drying methods such as fluidized bed drying and vacuum drying can be used for the second drying treatment. When an organic solvent remains in the toner particles in a relatively large amount, not only toner properties such as high temperature preservability, fixability and charging property deteriorate, but also a problem in that since the organic solvent is evaporated when toner images are fixed, the vapor of the organic solvent adversely affects the users, the image forming apparatus, and the peripheral machines is caused.

Next, the toner of the present invention, which is an example of a particulate material to be prepared by the particulate material production method of the present invention, will be described.

The toner is produced by a toner production apparatus using the toner production method of the present invention, and therefore has a sharp particle diameter distribution (i.e., the toner is like a monodisperse toner).

Specifically, the toner preferably has a particle diameter distribution (i.e., Dv/Dn ratio) of from 1.00 to 1.15, and more preferably from 1.00 to 1.05. The volume average particle diameter (Dv) of the toner preferably falls in a range of from 1 μm to 20 μm, and more preferably from 3 μm to 10 μm.

Next, the toner components constituting the toner will be described. Initially, the toner composition liquid in which the toner components are dissolved or dispersed in a solvent will be described.

Any known toner components for use in conventional electrophotographic toner can be used for the toner of the present invention. Specifically, the toner components include a binder resin, a colorant, a release agent (such as waxes), and additives such as charge controlling agents. The toner composition liquid is typically prepared by a method including dissolving a binder resin such as styrene acrylic resins, polyester resins, polyol resins, and epoxy resins, and dispersing a colorant in the resin solution while dispersing or dissolving therein a release agent, and optional additives such as charge controlling agents. The thus prepared toner composition liquid is ejected from nozzles as droplets, and the droplets are dried, by using the toner production method mentioned above to produce particles of the toner of the present invention.

The toner includes a binder resin, a colorant, and a release agent (such as waxes) as main components, and optionally includes other components such as charge controlling agents.

The binder resin is not particularly limited, and any known resins for use in conventional toner can be used. Specific examples thereof include homopolymers and copolymers of vinyl compounds such as styrene compounds, acrylic compounds, and methacrylic compounds; polyester resins, polyol resins, phenolic resins, silicone resins, polyurethane resins, polyamide resins, furan resins, epoxy resins, xylene resins, terpene resins, coumarone-indene resins, polycarbonate resins, and petroleum resins.

When a styrene acrylic resin is used as a binder resin, the resin preferably has a molecular weight distribution such that when tetrahydrofuran (THF)-soluble components of the resin are subjected to gel permeation chromatography (GPC) to obtain a molecular weight distribution curve, the curve has at least one peak in a molecular weight range of from 3,000 to 50,000 while having another peak at a molecular weight of not less than 100,000. By using such a binder resin, a good combination of fixability, offset resistance and preservability can be imparted to the toner. In addition, the resin preferably has a property such that the THF-soluble components thereof preferably include components having a molecular weight of not greater than 100,000 in an amount of from 50% to 90%. In addition, the resin preferably has a main peak in a molecular weight range of from 5,000 to 30,000, and more preferably from 5,000 to 20,000.

When a vinyl polymer is used as a binder resin, the vinyl polymer preferably has an acid value of from 0.1 mgKOH/g to 100 mgKOH/g, more preferably from 0.1 mgKOH/g to 70 mgKOH/g, and even more preferably from 0.1 mgKOH/g to 50 mgKOH/g.

When a polyester resin is used as a binder resin, the resin preferably has a molecular weight distribution such that when tetrahydrofuran (THF)-soluble components of the resin are subjected to gel permeation chromatography (GPC) to obtain a molecular weight distribution curve, the curve has at least one peak in a molecular weight range of from 3,000 to 50,000 so that a good combination of fixability and offset resistance can be imparted to the resultant toner. In addition, the resin preferably has a property such that the THF-soluble components thereof preferably include components having a molecular weight of not greater than 100,000 in an amount of from 60% to 100%. In addition, the resin preferably has at least one main peak in a molecular weight range of from 5,000 to 20,000.

When a polyester resin is used as a binder resin, the resin preferably has an acid value of from 0.1 mgKOH/g to 100 mgKOH/g, more preferably from 0.1 mgKOH/g to 70 mgKOH/g, and even more preferably from 0.1 mgKOH/g to 50 mgKOH/g.

In the present application, the molecular weight distribution of a resin is measured by gel permeation chromatography (GPC).

In addition, when a vinyl polymer and a polyester resin are used as binder resins, one of the resins preferably has a unit reactive with the other (i.e., the polyester resin or the vinyl polymer). Specific examples of the monomers for use in forming a unit, which is reactive with a vinyl polymer, in a polyester resin include unsaturated dicarboxylic acids or anhydrides such as phthalic acid, maleic acid, citraconic acid, and itaconic acid. Specific examples of the monomers for use in forming a unit, which is reactive with a polyester resin, in a vinyl polymer include monomers having a carboxyl group, or hydroxyl group, such as (meth)acrylic acid and esters thereof.

When a polyester resin, a vinyl polymer and another resin are used as binder resins, the content of resins having an acid value of from 0.1 mgKOH/g to 50 mgKOH/g is preferably not less than 60% by weight based on the total weight of the binder resin.

The acid value of a binder resin component is determined by the method described in JIS K-0070, which is as follows.

(1) At first, about 0.5 to 2.0 g of a sample (a binder resin), which is precisely measured. In this regard, when the sample includes other materials such as additives, the acid values and contents of the materials other than the binder resin component are previously determined. For example, when the acid value of the binder resin component included in a toner, which further includes a colorant and additives such as magnetic materials, is determined, the acid values of the colorant and the additives are previously determined and then the acid value of the toner is determined. The acid value of the binder resin component is calculated from these acid value data.

(2) The sample is mixed with 150 ml of a mixture solvent of toluene and ethanol (mixed in a volume ratio of 4:1) in a 300-ml beaker to be dissolved.

(3) The thus prepared solution is subjected to a potentiometric titration using a 0.1 mol/L ethanol solution of potassium hydroxide (KOH).

The acid value (AV) of the sample is calculated by the following equation.

$$AV\ (\text{mgKOH/g})=[(S-B)\times f\times 5.61]/W,$$

wherein S represents the amount of KOH consumed in the titration, B represents the amount of KOH consumed in the titration when a blank (i.e., a toluene/ethanol mixture solvent) is subjected to the titration, f represents the factor of N/10 potassium hydroxide, and W represents the precise weight of the sample.

Each of the binder resin of the toner and the toner of the present invention preferably has a glass transition temperature (Tg) of from 35° C. to 80° C., and more preferably from 40° C. to 75° C. In this case, the toner has good preservability. When the Tg is lower than 35° C., the toner tends to deteriorate under high temperature preservation conditions while causing an offset problem in a fixing process. In contrast, when the Tg is higher than 80° C., the fixability of the toner tends to deteriorate.

The following magnetic materials can be used for the toner of the present invention.

(1) Magnetic iron oxides such as magnetite, maghemite, and ferrite, and iron oxides including another metal oxide;

(2) Metals such as iron, cobalt, and nickel, and metal alloys of these metals with another metal such as aluminum, copper, lead, magnesium, tin, zinc, antimony, beryllium, bismuth, cadmium, calcium, manganese, selenium, titanium, tungsten, and vanadium; and (3) Mixtures of the materials mentioned above in paragraphs (1) and (2).

Specific examples of the magnetic materials include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O_{19}$, $NiFe_2O_4$, $NdFe_2O_3$, $BaFe_{12}O_{19}$, $MgFe_2O_4$, $MnFe_2O_4$, $LaFeO_3$, iron powders, cobalt powders, and nickel powders. These materials can be used alone or in combination. Among these materials, $Fe_3O_4$, and $\gamma$-$Fe_2O_3$ are preferable.

In addition, magnetic iron oxides (such as magnetite, maghemite, and ferrite) including another element, and mixtures thereof can also be used as the magnetic material. Specific examples of such an element include lithium, beryllium, boron, magnesium, aluminum, silicon, phosphorous, germanium, zirconium, tin, sulfur, calcium, scandium, titanium, vanadium, chromium, manganese, cobalt, nickel, copper, zinc, and gallium. The element can be included in an iron oxide as follows:

(1) The element is incorporated in an iron oxide crystal lattice;

(2) The element is included in an iron oxide in a form of an oxide thereof; and (3) The element is present on an iron oxide in a form of an oxide or hydroxide thereof.

Among these magnetic materials, the materials mentioned above in paragraph (2) are preferable.

These magnetic materials including another element can be prepared by mixing a salt of the element with raw materials of a magnetic material, and then preparing the magnetic material while controlling the pH, so that the element can be incorporated in particles of the magnetic material. Alternatively, by mixing particles of a magnetic material with a salt of the element before or after controlling the pH, the element can be precipitated on the surface of the magnetic particles.

The added amount of such a magnetic material in the toner of the present invention is from 10 parts to 200 parts by weight, and preferably from 20 to 150 parts by weight, based on 100 parts by weight of the binder resin component included in the toner. The number average particle diameter of such a magnetic material included in the toner is preferably from 0.1 μm to 2 μm, and more preferably from 0.1 μm to 0.5 μm. The number average particle diameter of a magnetic material can be determined by analyzing a photograph of the magnetic material, which is taken by a transmission electron microscope, using a digitizer.

The magnetic material included in the toner preferably has a coercivity of from 20 to 150 Oe, a saturation magnetization of from 50 to 200 emu/g, and a remanent magnetization of from 2 to 20 emu/g. Such a magnetic material can be used as a colorant.

The toner of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1% to 15% by weight, and more preferably from 3% to 10% by weight, based on the weight of the toner.

Master batches, which are complexes of a colorant with a resin, can be used as the colorant of the toner of the present invention. Specific examples of the resin used for preparing a master batch include the modified polyester resins and the unmodified polyester resins mentioned above. In addition, other resins can be used therefor.

Specific examples of such resins other than the polyester resins for use as the binder resin of the master batches include polymers of styrene or styrene derivatives (e.g., polystyrene, poly-p-chlorostyrene and polyvinyltoluene); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers); polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

The master batch can be prepared by mixing one or more of the resins mentioned above and one or more of the colorants mentioned above, and kneading the mixture while applying a high shearing force thereto. In this case, an organic solvent can be added to increase the interaction between the colorant and the resin. In addition, a flushing method, in which an aqueous paste including a colorant and water is mixed with a resin dissolved in an organic solvent and the mixture is kneaded so that the colorant is transferred to the resin side (i.e., the oil phase), followed by removing the organic solvent (and water, if desired), can be preferably used because the resultant wet cake can be used as it is without being dried. When performing the mixing and kneading process, dispersing devices capable of applying a high shearing force such as three roll mills can be preferably used.

The added amount of such a master batch in the toner of the present invention is from 0.1 to 20 parts by weight based on 100 parts by weight of the binder resin component included in the toner.

The resins for use as the master batch preferably have an acid value of not greater than 30 mgKOH/g (more preferably not greater than 20 mgKOH/g), and an amine value of from 1 to 100 mgKOH/g (more preferably 10 to 50 mgKOH/g) so that a colorant can be satisfactorily dispersed in the resultant master batch. When the acid value is greater than 30 mgKOH/g, the charging ability of the resultant toner tends to deteriorate under high humidity conditions, and the pigment dispersing ability of the resins tends to deteriorate. When the amine value is less than 1 mgKOH/g or greater than 100 mgKOH/g, the pigment dispersing ability of the resins tends to deteriorate. The amine value can be determined by the method described in JIS K7237.

The dispersant for use in the toner preferably has good compatibility with the binder resin used for the toner so that the colorant used for the toner can be satisfactorily dispersed in the toner. Specific examples of marketed dispersants for use in the toner of the present invention include AJISPER PB821 and AJISPER PB822 from Ajinomoto Fine-Techno Co., Ltd., DISPERBYK 2001 from Byk Chemie AG, and EFKA 4010 from EFKA (BASF).

The dispersants mentioned above preferably has a weight average molecular weight property such that a main peak has a maximum value in a range of from 500 to 100,000, and preferably from 3,000 to 30,000, which is determined by gel permeation chromatography (GPC) using a styrene-conversion method. When the weight average molecular weight is less than 500, the dispersant has too high a polarity, and therefore it becomes difficult to satisfactorily disperse a colorant. When the molecular weight is greater than 100,000, the affinity of the dispersant for a solvent increases, therefore it becomes difficult to satisfactorily disperse a colorant.

The added amount of a dispersant is preferably from 1 part to 200 parts by weight, and more preferably from 5 parts to 80 parts by weight, based on 100 parts by weight of the colorant included in the toner. When the added amount is less than 1 part by weight, it becomes difficult to satisfactorily disperse a colorant. When the added amount is greater than 200 parts by weight, the charging ability of the resultant toner tends to deteriorate.

The toner of the present invention includes a wax as a release agent. Any known materials used as release agents can be used for the toner of the present invention. Specific examples thereof include aliphatic hydrocarbon waxes such as low molecular weight polyethylene, low molecular weight polypropylene, polyolefin waxes, microcrystalline waxes, paraffin waxes, and sazol waxes; oxides of aliphatic hydrocarbon waxes such as oxidized polyethylene waxes, and copolymers thereof; vegetable waxes such as candellira waxes, carnauba waxes, Japan waxes, and Jojoba waxes); animal waxes such as bees waxes, lanolin, and whale waxes; mineral waxes such as ozocerite, ceresin waxes, and petrolatum; fatty acid ester waxes such as montan acid ester waxes, and caster waxes; and partially or entirely deacidificated fatty acid ester waxes such as deacidificated carnauba waxes.

In addition, other materials can be used as the release agent. Specific examples thereof include saturated linear fatty acids such as palmitic acid, stearic acid, montanic acid, and alkylcalboxylic acids having a linear alkyl group; unsaturated fatty acids such as plandinic acid, eleostearic acid, and valinalic acid; saturated alcohols such as stearyl alcohol, eicocyl alcohol, behenyl alcohol, carnaubil alcohol, ceryl alcohol, melissyl alcohol, and long-chain alkylalcohols; polyhydric alcohols such as sorbitol; fatty acid amides such as linoleic acid amide, oleic acid amide and lauric acid amide; saturated fatty acid bisamides such as methylenebisstearic acid amide, ethylenebiscapric acid amide, ethylenebislauric acid amide, and hexamethylenebisstearic acid amide; unsaturated fatty acid amides such as ethylenebisoleic acid amide, hexamethylenebisoleic acid amide, N,N'-dioleyladipic acid amide, and N,N'-dioleylcebasic acid amide; aromatic bisamides such as m-xylenebisstearic acid amide and N,N'-distearylisophthalic acid amide; metal salts of fatty acids (generally so-called metal soaps) such as calcium stearate, calcium laurate, zinc stearate, and magnesium stearate; grafted waxes such as aliphatic hydrocarbon waxes onto which a vinyl-containing monomer such as styrene or acrylic acid is grafted; partially esterified versions of reaction products of a fatty acid with a polyhydric alcohol such as behenic acid monoglyceride; and methyl ester compounds having a hydroxyl group obtained by hydrogenating vegetable oils and fats.

More preferable release agents are polyolefins prepared by radically polymerizing an olefin at a high pressure; polyolefins prepared by refining low molecular by-products obtained when preparing a high molecular weight polyolefin; polyolefins prepared by polymerizing an olefin at a low pressure using a catalyst such as a Ziegler catalyst and a metallocene catalyst; polyolefins prepared by polymerizing an olefin using radiation, electromagnetic waves, or light; low molecular weight polyolefins obtained by thermally decomposing a high molecular weight polyolefin; paraffin waxes, microcrystalline waxes, Fischer-Tropsch waxes, synthesized waxes prepared by using a Synthol method, a Hydrocol method, and an Arge method, synthesized waxes prepared by using a monomer having only one carbon atom, hydrocarbon waxes having a functional group such as hydroxyl group and carboxyl group, mixtures of a hydrocarbon wax and a hydrocarbon wax having a functional group, and waxes prepared by grafting a vinyl monomer such as styrene, maleic acid esters, acrylates, mechacrylates, and maleic anhydride onto one of the waxes mentioned above.

In addition, waxes which are obtained by sharpening the molecular weight distribution of the above-mentioned waxes using a method such as a press perspiration method, a solvent method, a re-crystallization method, a vacuum evaporation method, an extraction method using a supercritical gas, and a solution crystallization method; and waxes which are obtained by removing impurities (such as low molecular weight solid fatty acids, low molecular weight solid alcohols, and low molecular weight solid compounds) from the waxes mentioned above, can also be used as the release agent.

The waxes for use in the toner of the present invention preferably have a melting point of from 70° C. to 140° C., and more preferably from 70° C. to 120° C., to impart a good combination of fixability and offset resistance to the toner. When the melting point is lower than 70° C., the toner tends to cause a blocking problem in that the toner is blocked when preserved at a relatively high temperature. In contrast, when the melting point is higher than 140° C., the offset resistance tends to deteriorate.

By using a combination of two or more different kinds of waxes, a plasticizing effect and a releasing effect, both of which are effects of waxes, can be produced at the same time. In this regard, suitable waxes for use as the wax producing a plasticizing effect include waxes having a low melting point, waxes having a branched molecular structure, and waxes having a polar group. Suitable waxes for use as the wax producing a releasing effect include waxes having a high melting point, waxes having a linear molecular structure, and waxes having no functional group. For example, combinations of waxes whose melting points are different by 10° C. to 100° C., or combinations of a polyolefin wax and a grafted polyolefin wax can be preferably used.

When a combination of two waxes having a similar structure and different melting points is used, the wax having a lower melting point produces a plasticizing effect, and the wax having a higher melting point produces a releasing effect. In this regard, when the difference between the melting points is from 10° C. to 100° C., the plasticizing effect and the releasing effect can be effectively produced (i.e., a functional separation effect can be produced). When the difference in melting point is less than 10° C., the functional separation effect can be hardly produced. When the difference in melting point is greater than 100° C., the waxes hardly have an interaction with each other, and therefore the effects cannot be satisfactorily produced. When the difference in melting point of two waxes is from 10° C. to 100° C., it is preferable that one of the waxes has a melting point of from 70° C. to 120° C., and more preferably from 70° C. to 100° C.

Waxes having a branched structure, waxes having a polar group such as functional groups, and waxes modified with a component different from a main component of the waxes typically produce a plasticizing effect, and waxes having a linear structure, waxes having no polar (functional) group, and unmodified waxes (i.e., straight waxes) typically produce a releasing effect. Suitable combinations of waxes include combinations of a polyethylene homopolymer or copolymer including an ethylene unit as a main component and a polyolefin homopolymer or copolymer including an olefin unit other than ethylene as a main component; combinations of a polyolefin and a grafted polyolefin; combinations of one of an alcohol wax, a fatty acid wax and an ester wax, and a hydrocarbon wax; combinations of one of a Fischer-Tropsch wax and a polyolefin wax, and one of a paraffin wax and a microcrystalline wax; combinations of a Fischer-Tropsch wax and a polyolefin wax; combinations of a paraffin wax and a microcrystalline wax; and combinations of one of a carnauba wax, a candelilla wax, a rice wax and a montan wax, and a hydrocarbon wax.

In each case, the resultant toner preferably has a differential scanning calorimetric (DSC) property such that the peak top of a maximum endothermic peak is present in a temperature range of from 70° C. to 110° C., and more preferably the maximum endothermic peak is present within the temperature range of from 70° C. to 110° C.

The content of the wax component in the toner is preferably from 0.2 parts to 20 parts by weight, and more preferably from 0.5 parts to 10 parts by weight, based on 100 parts by weight of the binder resin component included in the toner.

In this application, the melting point of a wax is defined as the temperature of the peak top of the maximum endothermic peak of the wax in the DSC curve.

Suitable instruments for use as the differential scanning calorimeter (DSC) measuring the melting point of a wax or a toner include high-precision inner-heat type input compensation DSC. In this regard, it is preferable to use the measurement method defined in ASTM D3418-82. When a DSC curve of a material (wax or toner) is obtained, the material is initially subjected to a heating treatment, followed by a cooling treatment to delete the history of the material, and is then subjected to a heating treatment at a temperature rising speed of 10° C./min to obtain the DSC curve of the material.

The toner of the present invention can include a fluidizer. Such a fluidizer is typically added to the dried toner particles so as to be adhered to the surface of the toner particles, thereby improving the fluidity of the toner particles.

Specific examples of such a fluidizer include carbon blacks; particulate fluorine-containing resins such as polyvinylidene fluoride, and polytetrafluoroethylene; particulate silica such as silica prepared by a wet method, and silica prepared by a dry method; particulate titanium oxide, particulate alumina; and particulate silica, titanium oxide and alumina, whose surfaces are treated with a silane coupling agent, a titanium coupling agent, or a silicone oil. Among these materials, particulate silica, titanium oxide, and alumina are preferable, and particulate silica, titanium oxide, and alumina whose surfaces are treated with a silane coupling agent or a silicone oil are more preferable.

The fluidizer preferably has an average primary particle diameter of from 0.001 μm to 2 μm, and more preferably from 0.002 μm to 0.2 μm.

The above-mentioned particulate silica is silica prepared by a dry method or fumed silica, which is prepared by subjecting a halogenated silicone to a vapor phase oxidation treatment.

Specific examples of marketed products of such a silica include AEROSILs 130, 300, 380, TT600, MOX170, MOX80, and COK84 from Nippon Aerosil Co.; CAOSILs M-5, MS-7, MS-75, HS-5, and EH-5 from Cabot Corp.; HDKs N20, V15, N20E, T30, and T40 from Wacker Chemie; DC FINE SILICA from Dow Corning; and FRANSOL from Fransil.

The above-mentioned silica, which is prepared by subjecting a halogenated silicone to a vapor phase oxidation treatment, is preferably subjected to a hydrophobizing treatment so as to have a hydrophobic degree of from 30% to 80%, which is determined by a titration method using methanol. The hydrophobizing treatment is typically performed by chemically or physically treating a silica with an organic silicon compound, which can be reacted with silica or can adsorb on silica. Among treated silicas, silicas which are prepared by the vapor phase oxidation method and which are treated with an organic silicon compound are preferable.

Specific examples of such an organic silicon compound include hydroxypropyltrimethoxysilane, phenyltrimethoxysilane, n-hexadecyltrimethoxysilane, n-octadecyltrimethoxysilane, vinylmethoxysilane, vinyltriethoxysilane, vinyltriacetoxysilane, dimethylvinylchlorosilane, divinylchlorosilane, γ-methacryloyloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethyacetoxysilane, dimethyldiethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, 1,3-diphenyltetramethyldisiloxane, dimethylpolysiloxanes which have 2 to 12 siloxane units per molecule and in which the terminal unit thereof has 0 to 1 hydroxyl group connected with a silicon atom, and silicone oils such as dimethylsilicone oils. These compounds can be used alone or in combination.

The fluidizer for use in the toner of the present invention preferably has a number average particle diameter of from 5 nm to 100 nm, and more preferably from 5 nm to 50 nm.

In addition, the fluidizer preferably has a BET specific surface area of not less than 30 $m^2/g$, and preferably from 60 to 400 $m^2/g$. When the fluidizer is subjected to a surface treatment, the fluidizer preferably has a BET specific surface area of not less than 20 $m^2/g$, and preferably from 40 to 300 $m^2/g$.

The mixing ratio (F/T) of a fluidizer (F) to toner particles (T) is from 0.03/100 to 8/100 by weight.

In order to protect the surfaces of an electrostatic latent image bearer and carrier, to enhance the cleanability and fixability of the toner, and to adjust the thermal properties, electric properties and physical properties of the toner such as electric resistance and softening point, other additives such as metal soaps, fluorine-containing surfactants, plasticizers (dioctylphthalate), electroconductive agents (e.g., tin oxide, zinc oxide, carbon black, and antimony oxide), and particulate inorganic materials (e.g., titanium oxide, and aluminum oxide) can be optionally added to the toner (i.e., the toner composition liquid). Such particulate inorganic materials may be hydrophobized if desired. Further, lubricants (e.g., polytetrafluoroethylene, zinc stearate, and polyvinylidene fluoride), abrasives (e.g., cerium oxide, silicon carbide, and strontium titanate), caking inhibitors, and developing ability improving agents such as particulate white or black materials having a polarity opposite that of the toner can also be used as additives.

In order to control the charge quantity of the toner or the like, these additives can be treated with a treatment agent such as organic silicon compounds (e.g., silicone varnishes, modified silicone varnishes, silicone oils, modified silicone oils, silane coupling agents, and silane coupling agents having a functional group), and other treatment agents.

When preparing a toner, a particulate inorganic material such as the hydrophobized silicas mentioned above can be added to the toner to enhance the fluidity, preservability, developing ability, and transferability of the toner. Any known mixers for use in mixing powders can be used for mixing a toner with an additive, and mixers having a jacket to control the inner temperature of the mixers can be preferably used. It is possible to change the mixing conditions such as rotation speed and rolling speed of the mixer, mixing time, and mixing temperature, to change the stress on the external additive in a mixing process. In addition, a mixing method in which initially a relatively high stress is applied and then a relatively low stress is applied to the external additive, or vice versa; a method in which an external additive is gradually added to toner particles while mixing the mixture; or a method in which initially toner particles are agitated by a mixer for a predetermined period of time and then an external additive is added to the agitated toner particles, can also be used.

Specific examples of the mixers include V-form mixers, locking mixers, LOEDGE MIXER mixers, NAUTER MIXER mixers, and HENSCHEL MIXER mixers.

Suitable materials for use as the external additive include particulate inorganic materials. Specific examples thereof include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. The particulate inorganic materials for use in the toner preferably have an average primary particle diameter of from 5 nm to 2 μm, and more preferably from 5 nm to 500 nm.

In addition, the particulate inorganic materials preferably have a BET specific surface area of from 20 to 500 $m^2/g$. The content of a particulate inorganic material in the toner is preferably from 0.01% to 5% by weight, and more preferably from 0.01% to 2.0% by weight, based on the weight of the toner.

Further, particulate polymers such as polystyrene, polymethacrylates, and polyacrylate copolymers, which are prepared by a polymerization method such as soap-free emulsion polymerization methods, suspension polymerization methods and dispersion polymerization methods; and particulate polymers such as silicone, benzoguanamine resins, and nylon resins, which are prepared by a polymerization method such as polycondensation methods; and particles of a thermosetting resin, can also be used as external additives.

The external additive for use in the toner of the present invention is preferably subjected to a hydrophobizing treatment to prevent deterioration of the properties thereof particularly under high humidity conditions. Suitable hydrophobizing agents for use in the hydrophobizing treatment include silane coupling agents, silylation agents, silane coupling agents having a fluorinated alkyl group, organic titanate coupling agents, aluminum coupling agents, and silicone oils.

In addition, the toner preferably includes a cleanability improving agent which can impart good cleaning property to the toner such that particles of the toner remaining on the surface of an image bearing member such as a photoreceptor and an intermediate transfer medium even after a toner image is transferred therefrom can be easily removed therefrom. Specific examples of such a cleanability improving agent include fatty acids and their metal salts such as stearic acid, zinc stearate, and calcium stearate; and particulate polymers such as polymethyl methacrylate and polystyrene, which are manufactured by a method such as soap-free emulsion polymerization methods. Among such particulate resins, particulate resins having a relatively narrow particle diameter distribution and a volume average particle diameter of from 0.01 μm to 1 μm are preferably used as the cleanability improving agent.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

1. Preparation of Colorant Dispersion

The following components were mixed.

| | |
|---|---|
| Carbon black (REGAL 400 from Cabot Corp.) | 17 parts |
| Dispersant (copolymer having a basic functional group, AJISPER PB821 from Ajinomoto Fine-Techno Co., Ltd.) | 3 parts |
| Ethyl acetate | 80 parts |

The mixture was subjected to a primary dispersing treatment using a mixer having a rotor blade. The thus prepared primary dispersion was subjected to a secondary dispersing treatment using a bead mill (LMX-type bead mill from Ashizawa Finetech Ltd.), which uses zirconia beads with a diameter of 0.3 mm and which can apply a strong shearing force, to prepare a dispersion of the carbon black, which did not include aggregates of the carbon black having a particle diameter of not less than 5 μm. Thus, a colorant dispersion was prepared.

2. Preparation of Wax Dispersion

The following components were mixed.

| | |
|---|---|
| Carnauba wax | 18 parts |
| Dispersant (polyethylene wax on which a styrene-butyl acrylate copolymer is grafted) | 2 parts |
| Ethyl acetate | 80 parts |

The mixture was subjected to a primary dispersing treatment using a mixer having a rotor blade. The primary dispersion was heated to 80° C. to dissolve the carnauba wax, and the solution was cooled to room temperature to precipitate a particulate carnauba wax having a maximum particle diameter of not greater than 3 μm. The thus prepared dispersion was subjected to a secondary dispersing treatment using a bead mill (LMX-type bead mill from Ashizawa Finetech Ltd.), which uses zirconia beads with a diameter of 0.3 mm and which can apply a strong shearing force, to prepare a dispersion of the carnauba wax having a maximum particle diameter of not greater than 1 μm. Thus, a wax dispersion was prepared.

3. Preparation of Toner Composition Liquid (Solution or Dispersion)

The following components were mixed for 10 minutes using a mixer having a rotor blade to prepare a toner composition liquid (solution or dispersion).

| | |
|---|---|
| Polyester resin | 100 parts |
| Colorant dispersion prepared above | 30 parts |
| Wax dispersion prepared above | 30 parts |
| Ethyl acetate | 840 parts |

In this regard, when mixing the components, a problem in that the pigment particles and wax particles are shocked by the solvent and aggregate was not caused.

4. Toner Production Apparatus

A toner production apparatus having such a structure as illustrated in FIG. 1 and using a droplet ejecting head, which is a liquid column resonance type droplet ejector and which has such a structure as illustrated in FIG. 4, was used to eject droplets of the toner composition liquid prepared above.

In this regard, the droplet ejection conditions were as follows.

(1) The length L of the liquid column resonance chamber 22: 1.85 mm (2) Resonance mode: N=2

(3) Position of first to fourth nozzles: A position corresponding to the antinode of the pressure standing wave in N=2 mode (4) Drive signal generator: Function generator WF1973 from NF Corp. This function generator was connected with a vibrator with a wire covered with polyethylene to vibrate the vibrator.

(5) Chamber 62: A cylindrical chamber, which has such a shape as illustrate in FIG. 1 and has an inner diameter of 300 mm and a height of 2000 mm and which is set so as to be extend vertically, is used.

(6) Droplet ejector 11: A droplet ejector 11 was provided at a location of the chamber, which is 50 mm apart from the entrance from which the carrier air is supplied, in such a manner that the droplet ejection direction is perpendicular to the flow direction of the carrier air.

(7) Passage of carrier air 31: A passage of carrier air 31 having a rectangular cross-section was formed on an upper portion of the chamber. The width, height and length of the passage are 80 mm, 30 mm, and 200 mm, respectively.

(8) Toner collector 63: A toner collector was connected with the exit of the chamber 62.

(9) Toner container 64: A toner container was connected with the toner collector 63.

Example 1

The above-prepared toner composition liquid was ejected using the above-mentioned toner production apparatus so as to be dried in the chamber 62. Dried particles (i.e., toner particles) in the chamber 62 were collected by the toner collector 63, and then stored in the toner container 64. Thus, a toner of Example 1 was prepared. In this regard, the production conditions were as follows.

(1) Applied voltage: A sine-wave voltage having a peak value of 12.0V, and a frequency of 340 kHz was used.

(2) Velocity of carrier air: 32 m/s (3) Diameter of droplets: 11.8 μm, which was measured by a laser shadowgraphy method.

(4) Ejection velocity: 20 m/s in average, which was measured by a laser shadowgraphy method.

The volume average particle diameter (Dv) and number average particle diameter (Dn) of the toner of Example 1 were measured with a flow particle image analyzer FPIA-3000 from Sysmex Corp. As a result, the volume average particle diameter (Dv) and number average particle diameter (Dn) of the toner of Example 1 were 5.6 μm and 5.3 μm, respectively. In this case, the average ratio (Dv/Dn) was 1.06.

The particle diameter measuring method was as follows.

(1) A few drops of a nonionic surfactant (CONTAMIN N from Wako Pure Chemical Industries, Ltd.) was added to 10 ml of water, which had been subjected to a filtering treatment to remove foreign particles to an extent such that the number of particles having a circle-equivalent diameter in a measurement range of from 0.60 μm to 159.21 μm is not greater than 20 in a unit volume of $10^{-3}$ $cm^3$;

(2) Five (5) milligrams of a sample (toner) was added thereto, and the mixture was subjected to a dispersing treatment for 1 minute using a supersonic dispersing machine UH-50 from STM Co., Ltd. under conditions of 20 kHz in frequency and 50 W/10 $cm^3$ in power. This dispersing treatment was performed 5 times to prepare a sample dispersion in which toner particles of from 4,000 to 8,000 are present in a unit volume of 1 $cm^3$. The particle diameter distribution of the toner particles in the sample dispersion in a range of from 0.60 μm to 159.21 μm was measured with the flow particle image analyzer.

The sample dispersion was passed through a transparent flat and thin flow cell of the analyzer having a thickness of about 200 μm. In the analyzer, a flash lamp is provided in the vicinity of the flow cell to emit light at intervals of 1/30 seconds so as to pass through the flow cell in the thickness direction thereof, and a CCD camera is provided on the opposite side of the flash lamp with the flow cell therebetween to catch the toner particles passing through the flow cell as two-dimensional images. The circle-equivalent particle diameter of each toner particle (i.e., the particle diameter of a circle having the same area as a toner particle) was determined from the two-dimensional images taken by the CCD camera.

The analyzer could measure the circle-equivalent particle diameters of more than 1200 particles in 1 minute, and the number-basis percentage of each of particle diameter channels of the toner particles could be determined. In this regard, the particle diameter range of from 0.06 μm to 400 μm is divided into 226 channels (i.e., 30 channels for 1 octave). In this measurement, the particle diameter range is from 0.06 μm to 159.21 μm. Thus, the number-basis percentage of each of particle diameter channels of the toner particles, and accumulated percentage could be determined.

Example 2

The procedure for preparation of the toner of Example 1 was repeated except that the velocity of the carrier air was changed to 60 m/s. As a result, the particle diameter and the velocity of the ejected droplets were 11.8 μm and 20 m/s, and the volume average particle diameter (Dv), the number average particle diameter (Dn), and the ratio (Dv/Dn) of the toner of Example 2 were 5.6 μm, 5.2 μm, and 1.08, respectively.

Example 3

The procedure for preparation of the toner of Example 1 was repeated except that the velocity of the carrier air was changed to 15 m/s. As a result, the particle diameter and the velocity of the ejected droplets were 11.8 μm and 20 m/s, and the volume average particle diameter (Dv), the number average particle diameter (Dn), and the ratio (Dv/Dn) of the toner of Example 3 were 5.8 μm, 5.3 μm, and 1.09, respectively.

Example 4

The procedure for preparation of the toner of Example 1 was repeated except that the velocity of the carrier air was changed to 9 m/s. As a result, the particle diameter and the velocity of the ejected droplets were 11.8 μm and 20 m/s, and the volume average particle diameter (Dv), the number average particle diameter (Dn), and the ratio (Dv/Dn) of the toner of Example 4 were 5.9 μm, 5.3 μm, and 1.11, respectively.

Example 5

The procedure for preparation of the toner of Example 1 was repeated except that the peak value of the sine-wave voltage was changed to 10.0V. As a result, the particle diameter and the velocity of the ejected droplets were 11.0 μm and 14 m/s, and the volume average particle diameter (Dv), the number average particle diameter (Dn), and the ratio (Dv/Dn) of the toner of Example 5 were 5.7 μm, 5.2 μm, and 1.10, respectively.

Example 6

The procedure for preparation of the toner of Example 1 was repeated except that the peak value of the sine-wave voltage was changed to 8.0V. As a result, the particle diameter and the velocity of the ejected droplets were 10.8 μm and 9.5 m/s, and the volume average particle diameter (Dv), the number average particle diameter (Dn), and the ratio (Dv/Dn) of the toner of Example 6 were 6.2 μm, 5.4 μm, and 1.15, respectively.

Comparative Example 1

The procedure for preparation of the toner of Example 1 was repeated except that the droplet ejector 11 was set so as to eject droplets downward, and the carrier air was not used. As a result, the particle diameter and the velocity of the ejected droplets were 11.8 μm and 20 m/s, and the volume average particle diameter (Dv), the number average particle diameter (Dn), and the ratio (Dv/Dn) of the toner of Comparative Example 1 were 8.8 μm, 6.2 μm, and 1.42, respectively. Thus, the toner had a relatively wide particle diameter distribution due to formation of united particles.

Comparative Example 2

The procedure for preparation of the toner of Example 1 was repeated except that a shroud cover and an airflow generator were provided on the droplet ejector 11 so that droplets are ejected downward and the carrier air is supplied by the airflow generator at a velocity of 32 m/s in the same direction as the droplet ejection direction. As a result, the particle diameter and the velocity of the ejected droplets were 11.8 μm and 20 m/s, and the volume average particle diameter (Dv), the number average particle diameter (Dn), and the ratio (Dv/Dn) of the toner of Comparative Example 2 were 6.6 μm, 5.4 μm, and 1.22, respectively. Thus, the toner had a relatively wide particle diameter distribution due to formation of united particles.

As mentioned above, in this example of the toner production method and apparatus, the toner composition liquid 12 contained in the toner composition liquid container 13 is supplied by the circulating pump 16 to the droplet ejector 11 through the liquid supply tube 14. After the toner composition liquid 12 is supplied to the common liquid passage 21 of the droplet ejector 11, the toner composition liquid is supplied to the liquid column resonance chamber 22. Since a pressure distribution is formed in the liquid column resonance chamber 22 by a liquid column resonance standing wave generated by the vibrator 25, droplets of the toner composition liquid 12 are ejected from the droplet ejection nozzles 24, which are arranged at a location of the chamber 22 corresponding to the antinode of the standing wave. Therefore, as illustrated in FIG. 2, the droplets 23 of the toner composition liquid 12 ejected by the nozzles 24 are curved by the carrier air 31 so as to be fed in a direction different from the droplet ejection direction. In this regard, the flow direction of the carrier air 31 is substantially perpendicular to the droplet ejection direction. Therefore, the velocity of the droplets 23 is increased. In addition, since the feeding direction of the droplets 23 is forcibly curved, the distance between ejected droplets becomes longer than the distance between the droplets just after ejected, thereby preventing occurrence of the droplet uniting problem, resulting in formation of a toner having a sharp particle diameter distribution.

Additional modifications and variations of the present invention are possible in light of the above teachings. It is therefore to be understood that within the scope of the appended claims the invention may be practiced other than as specifically described herein.

What is claimed is:

1. A particulate material production apparatus for producing a particulate material, comprising:

at least one droplet ejector including:

a liquid column resonance chamber which contains a particulate material composition liquid therein and which has at least one nozzle, wherein the particulate material composition liquid includes at least a solvent, and a component of the particulate material dissolved or dispersed in the solvent; and a vibrator to vibrate the particulate material composition liquid in the liquid column resonance chamber to form a standing wave in the particulate material composition liquid, so that droplets of the particulate material composition liquid are ejected in a droplet ejection direction from the at least one nozzle so as to fly in a space in a flight direction, wherein the at least one nozzle is located at a location corresponding to an antinode of the standing wave;

a gas feeder to feed a gas in a direction substantially perpendicular to the droplet ejection direction to change the flight direction of the ejected droplets; and a solidifying device to solidify the ejected droplets in the space to form the particulate material.

2. The particulate material production apparatus according to claim 1, wherein the particulate material is a toner, and the particulate material composition liquid is a toner composition liquid including at least a binder resin, a colorant, and a solvent in which each of the binder resin and the colorant is dissolved or dispersed.

3. The particulate material production apparatus according to claim 1, wherein the at least one droplet ejector comprises a plurality of droplet ejecting heads.

4. The particulate material production apparatus according to claim 2, further comprising a toner composition liquid container, and a pump to pressure-feed the toner composition liquid from the toner composition liquid container to the at least one droplet ejector through a liquid supply tube.

5. The particulate material production apparatus according to claim 4, further comprising a liquid return tube from the at least one droplet ejector to the toner composition liquid container.

6. The particulate material production apparatus according to claim 1, further comprising a toner collector and toner container, which combine with the solidifying device to form a drying and collecting unit.

* * * * *